US008894061B2

(12) United States Patent
Matsuoka

(10) Patent No.: US 8,894,061 B2
(45) Date of Patent: Nov. 25, 2014

(54) SHEET CONVEYING APPARATUS AND IMAGE FORMING APPARATUS PROVIDED WITH SAME

(71) Applicant: KYOCERA Document Solutions Inc., Osaka (JP)

(72) Inventor: Keiji Matsuoka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/916,868

(22) Filed: Jun. 13, 2013

(65) Prior Publication Data

US 2013/0334762 A1 Dec. 19, 2013

(30) Foreign Application Priority Data

Jun. 14, 2012 (JP) ..... 2012-134553

(51) Int. Cl.

| | |
|---|---|
| ***B65H 5/00*** | (2006.01) |
| ***B65H 5/06*** | (2006.01) |
| ***B65H 1/26*** | (2006.01) |
| ***B65H 3/06*** | (2006.01) |

(52) U.S. Cl.

CPC ..... *B65H 5/06* (2013.01); *B65H 1/266* (2013.01); *B65H 3/0607* (2013.01); *B65H 3/0669* (2013.01); *B65H 3/0684* (2013.01); *B65H 2402/441* (2013.01); *B65H 2402/63* (2013.01); *B65H 2405/15* (2013.01); *B65H 2405/312* (2013.01); *B65H 2405/313* (2013.01); *B65H 2601/324* (2013.01); *B65H 2801/06* (2013.01)

USPC ..... 271/10.13

(58) Field of Classification Search

CPC .... B65H 3/0669; B65H 3/5261; B65H 3/062; B65H 3/06; B65H 3/0684

USPC ..... 271/10.13

See application file for complete search history.

(56) References Cited

U.S. PATENT DOCUMENTS

| | | | | |
|---|---|---|---|---|
| 5,040,779 | A * | 8/1991 | Ogiri et al. | 271/109 |
| 5,156,388 | A * | 10/1992 | Morita | 271/109 |
| 8,585,039 | B2 * | 11/2013 | Murata | 271/18 |
| 8,678,386 | B2 * | 3/2014 | Hata | 271/272 |
| 2004/0251601 | A1 * | 12/2004 | Nagao | 271/162 |
| 2004/0256787 | A1 * | 12/2004 | Wada et al. | 271/109 |

(Continued)

FOREIGN PATENT DOCUMENTS

| | | |
|---|---|---|
| JP | 6-144606 | 5/1994 |
| JP | 7-25494 | 1/1995 |

*Primary Examiner* — Prasad Gokhale

(74) *Attorney, Agent, or Firm* — Gerald E. Hespos; Michael J. Porco; Matthew T. Hespos

(57) ABSTRACT

A sheet conveying apparatus includes a casing with an internal space, a sheet placing portion, a sheet feeding unit, a driving unit, an opening/closing cover and a drive switching unit. A sheet is to be placed on the sheet placing portion. The sheet feeding unit includes a sheet feeding member. The driving unit is arranged in the internal space and coupled to a rotational drive system of the sheet feeding member and transmits a rotational drive force to the sheet feeding member. The opening/closing cover is openably and closably arranged on the casing to cover a opening formed in the casing. The drive switching unit uncouples the driving unit and the sheet feeding member in association with a switching movement of the opening/closing cover from a closed state to the open state. The sheet feeding unit is mountable into and removable from the internal space through the opening.

16 Claims, 22 Drawing Sheets

(56) References Cited

U.S. PATENT DOCUMENTS

2008/0012200 A1* 1/2008 Lin et al. ..... 271/10.13
2008/0217840 A1* 9/2008 Shiraki et al. ..... 271/126
2009/0267293 A1* 10/2009 Watanabe et al. ..... 271/264
2009/0302520 A1* 12/2009 Shimmachi et al. ..... 271/4.1

* cited by examiner

SHEET CONVEYING APPARATUS AND IMAGE FORMING APPARATUS PROVIDED WITH SAME

This application is based on Japanese Patent Application Serial No. 2012-134553 filed with the Japan Patent Office on Jun. 14, 2012, the contents of which are hereby incorporated by reference.

BACKGROUND

The present disclosure relates to a sheet conveying apparatus for conveying a sheet and an image forming apparatus provided with the same.

Conventionally, a sheet feeder to be mounted in an image forming apparatus is known as a sheet conveying apparatus for conveying a sheet. In such a sheet feeder, sheets are stacked on a sheet placing portion, and the uppermost sheet is conveyed to an image forming unit of the image forming apparatus. Such a sheet feeder includes a feed roller.

The feed roller can come into contact with the stacked sheets and conveys the sheets to a downstream side in a sheet conveying direction. A rotational drive force is input to the feed roller from a driving unit, whereby the feed roller is driven and rotated to convey a sheet. Conventionally, there is known a technology for removing the feed roller from the sheet feeder after drive transmission between the driving unit and the feed roller is manually cut off for the exchange of such a feed roller.

The present disclosure aims to make a sheet feeding member, to which a drive force is input from an apparatus main body of a sheet conveying apparatus, easily exchangeable.

SUMMARY

A sheet conveying apparatus according to one aspect of the present disclosure includes a casing with an internal space, a sheet placing portion, a sheet feeding unit, a driving unit, an opening, an opening/closing cover and a drive switching unit. The sheet placing portion is arranged in the internal space and a sheet is to be placed thereon. The sheet feeding unit is arranged in the internal space to face the sheet and includes a sheet feeding member for conveying the sheet in a predetermined direction by being driven and rotated. The driving unit is arranged in the internal space and coupled to a rotational drive system of the sheet feeding member and transmits a rotational drive force to the sheet feeding member. The opening is formed in the casing and exposes the sheet feeding unit to the outside of the casing. The opening/closing cover is openably and closably arranged on the casing to cover the opening and exposes the sheet feeding unit in an open state. The drive switching unit uncouples the driving unit and the sheet feeding member in association with a switching movement of the opening/closing cover from a closed state to the open state. The sheet feeding unit is mountable into and removable from the internal space through the opening in the open state of the opening/closing cover.

Further, an image forming apparatus according to another aspect of the present disclosure includes the above sheet conveying apparatus and an image forming unit. The image forming unit forms an image on a sheet.

These and other objects, features and advantages of the present disclosure will become more apparent upon reading the following detailed description along with the accompanying drawings.

DETAILED DESCRIPTION

Figure 1:
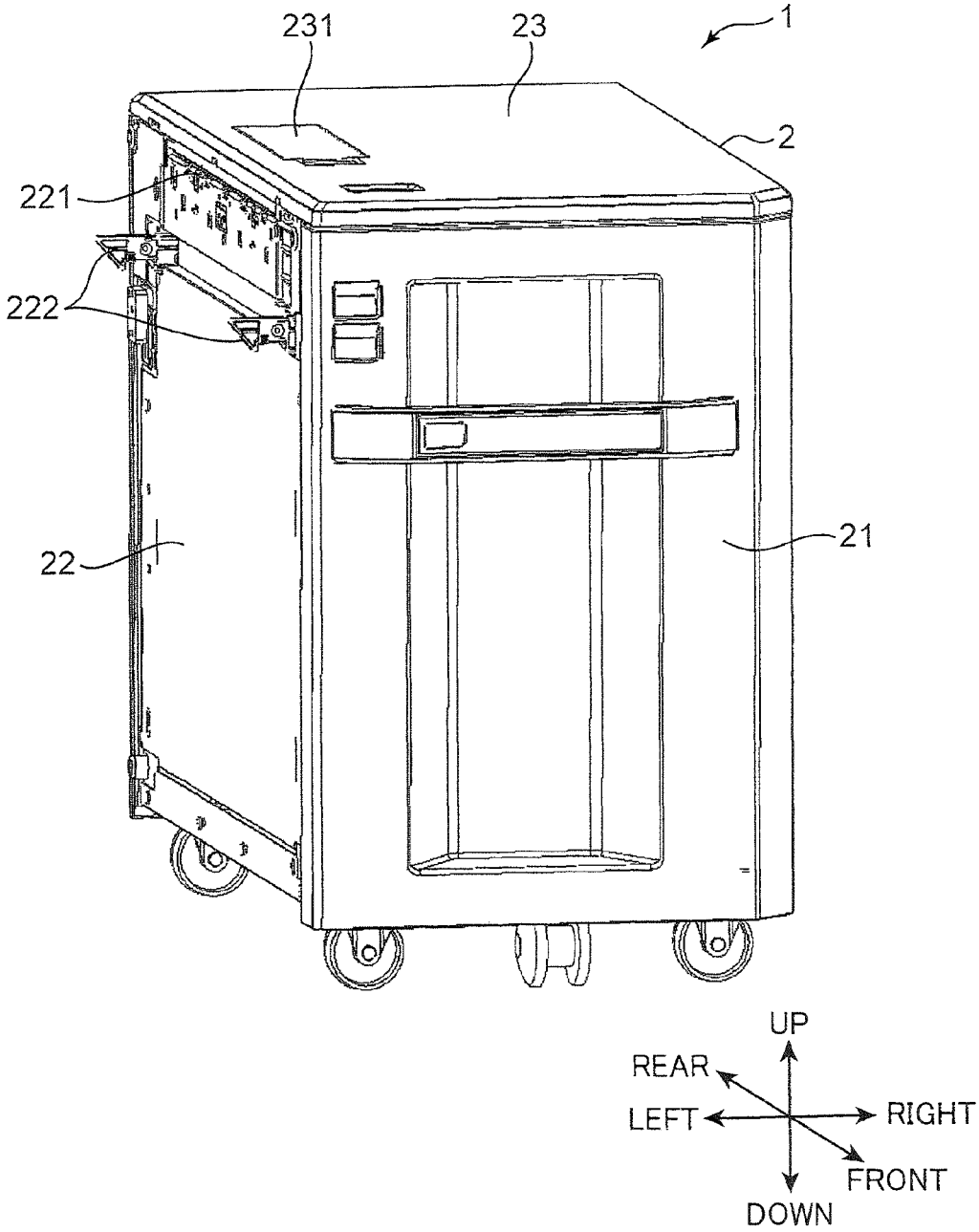
FIG. 1 is a perspective view of a sheet conveying apparatus according to one embodiment of the present disclosure.
Figure 2:
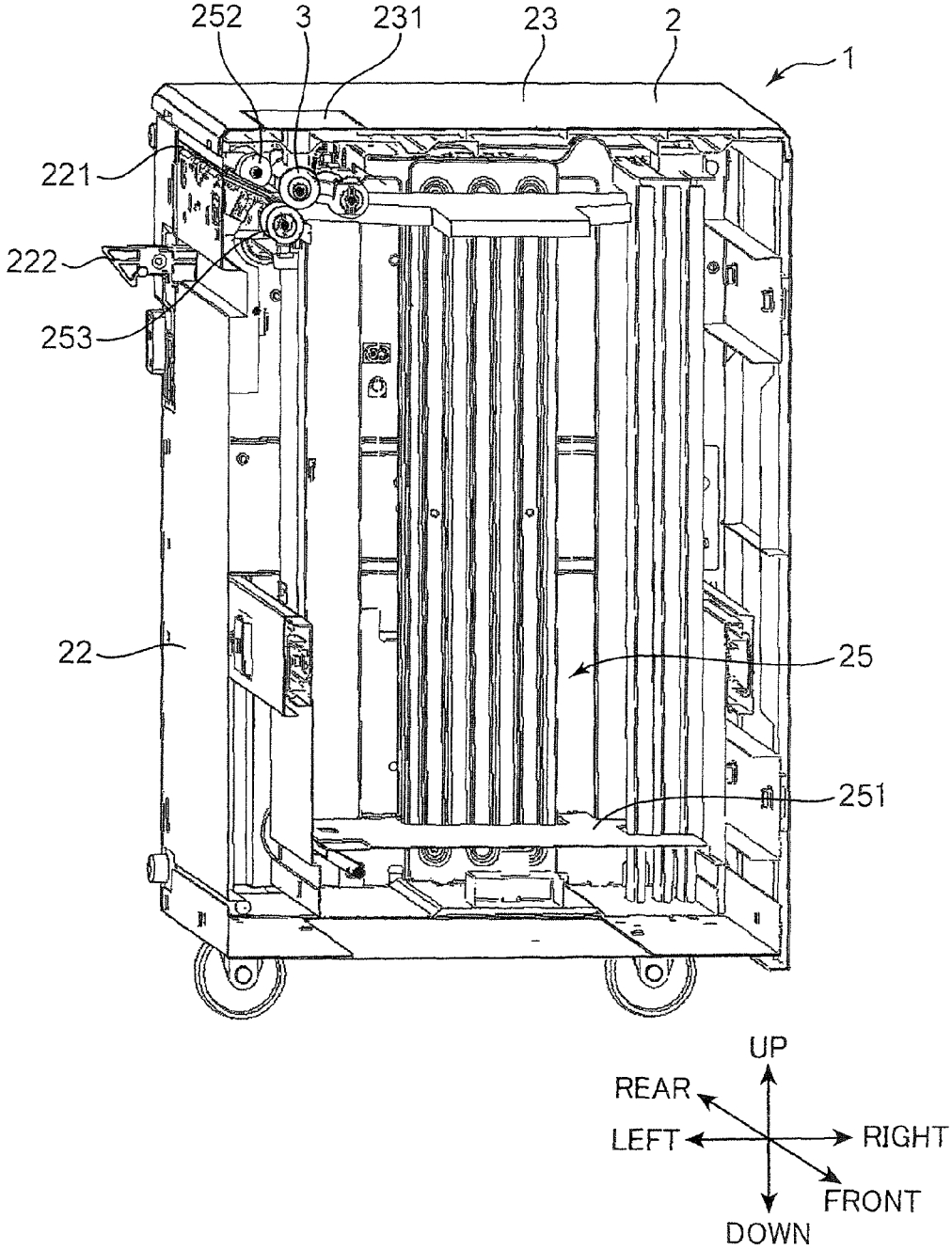
FIG. 2 is a sectional perspective view showing the internal structure of the sheet conveying apparatus according to the one embodiment of the present disclosure.
Figure 3:
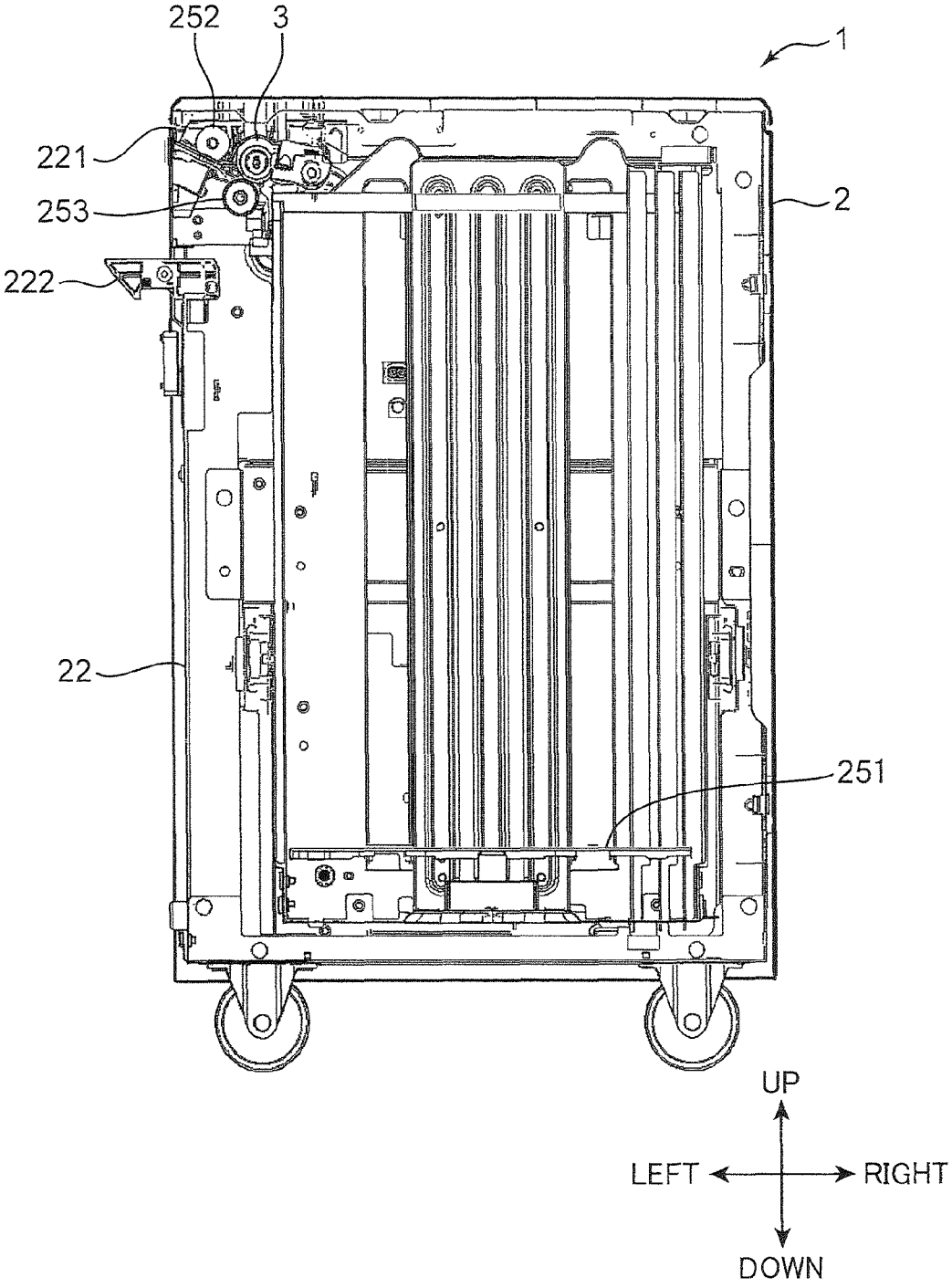
FIG. 3 is a sectional view showing the internal structure of the sheet conveying apparatus according to the one embodiment of the present disclosure.
Figure 4:
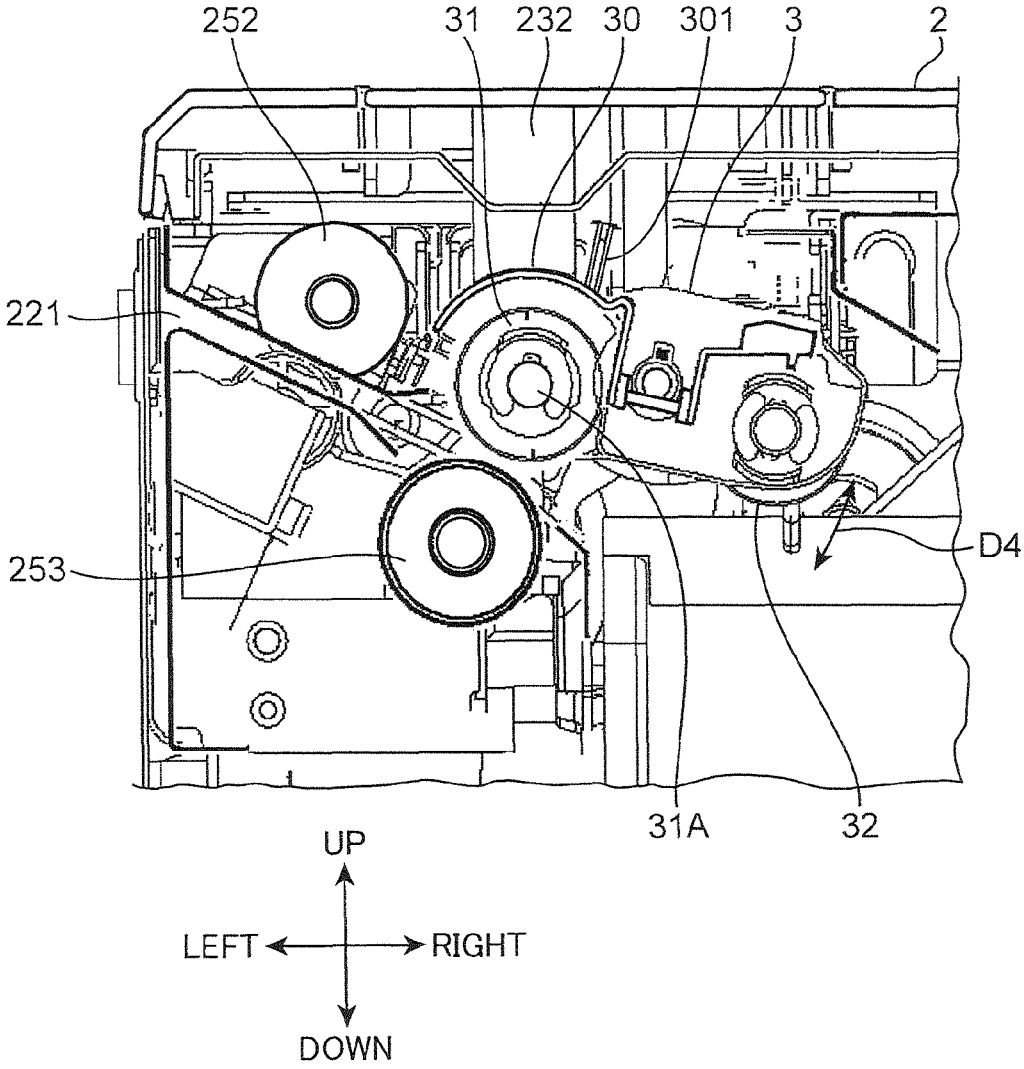
FIG. 4 is an enlarged sectional view of a sheet feeding device which is an essential part of the sheet conveying apparatus according to the one embodiment of the present disclosure.
Figure 5:
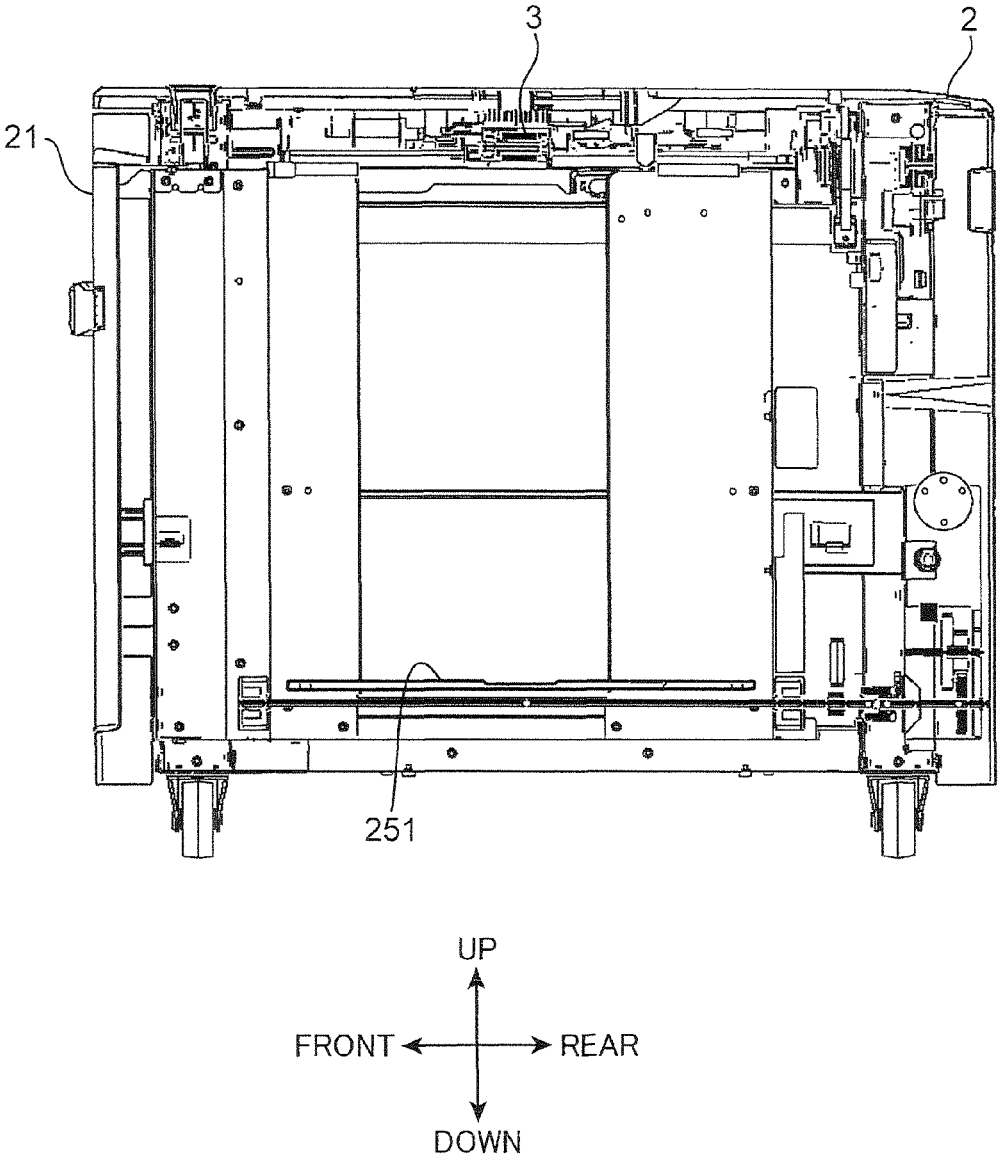
FIG. 5 is a sectional view showing the arrangement of a sheet feeding unit in the sheet conveying apparatus according to the one embodiment of the present disclosure.
Figure 6:
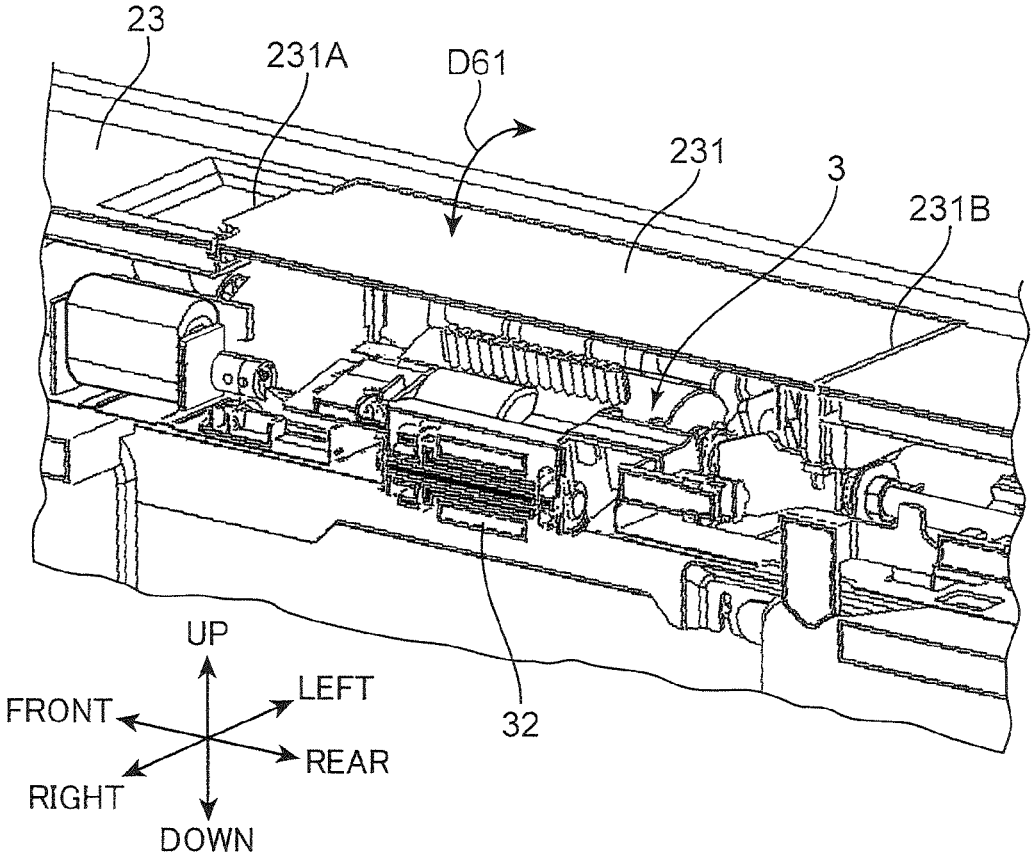
FIG. 6 is a sectional perspective view showing the arrangement of the sheet feeding unit according to the one embodiment of the present disclosure.
Figure 7A:
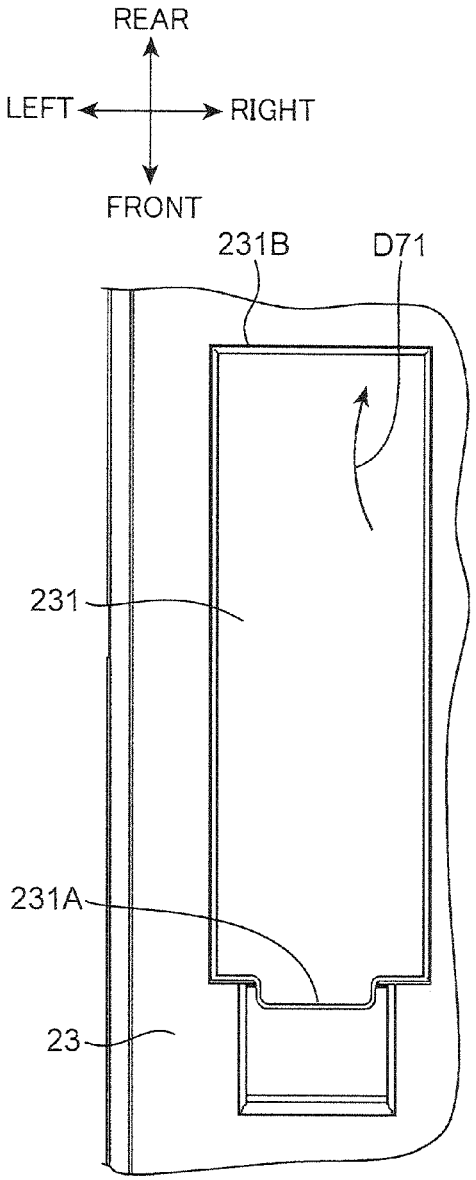
FIGS. 7A and 7B are plan views showing a state where the sheet feeding unit is exposed as an opening/closing cover is opened and closed.
Figure 7B:
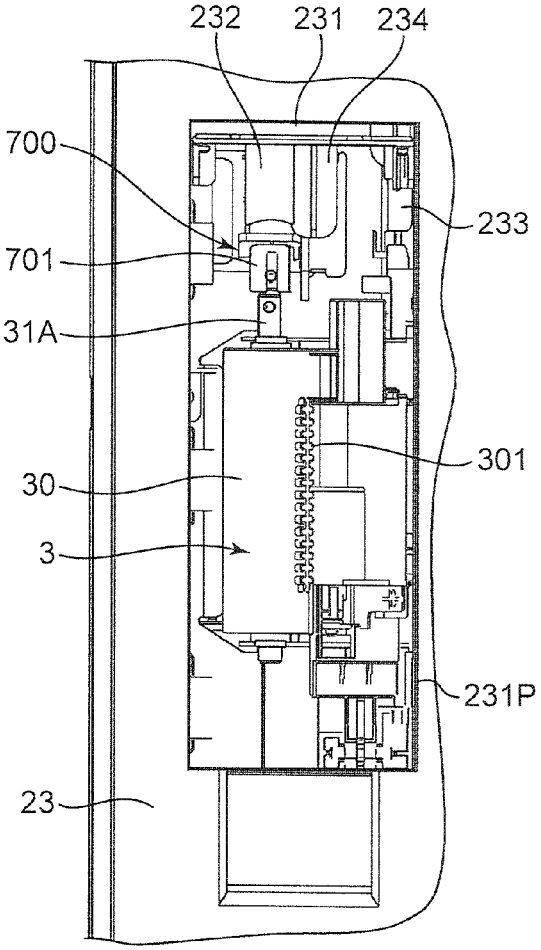
Figure 8:
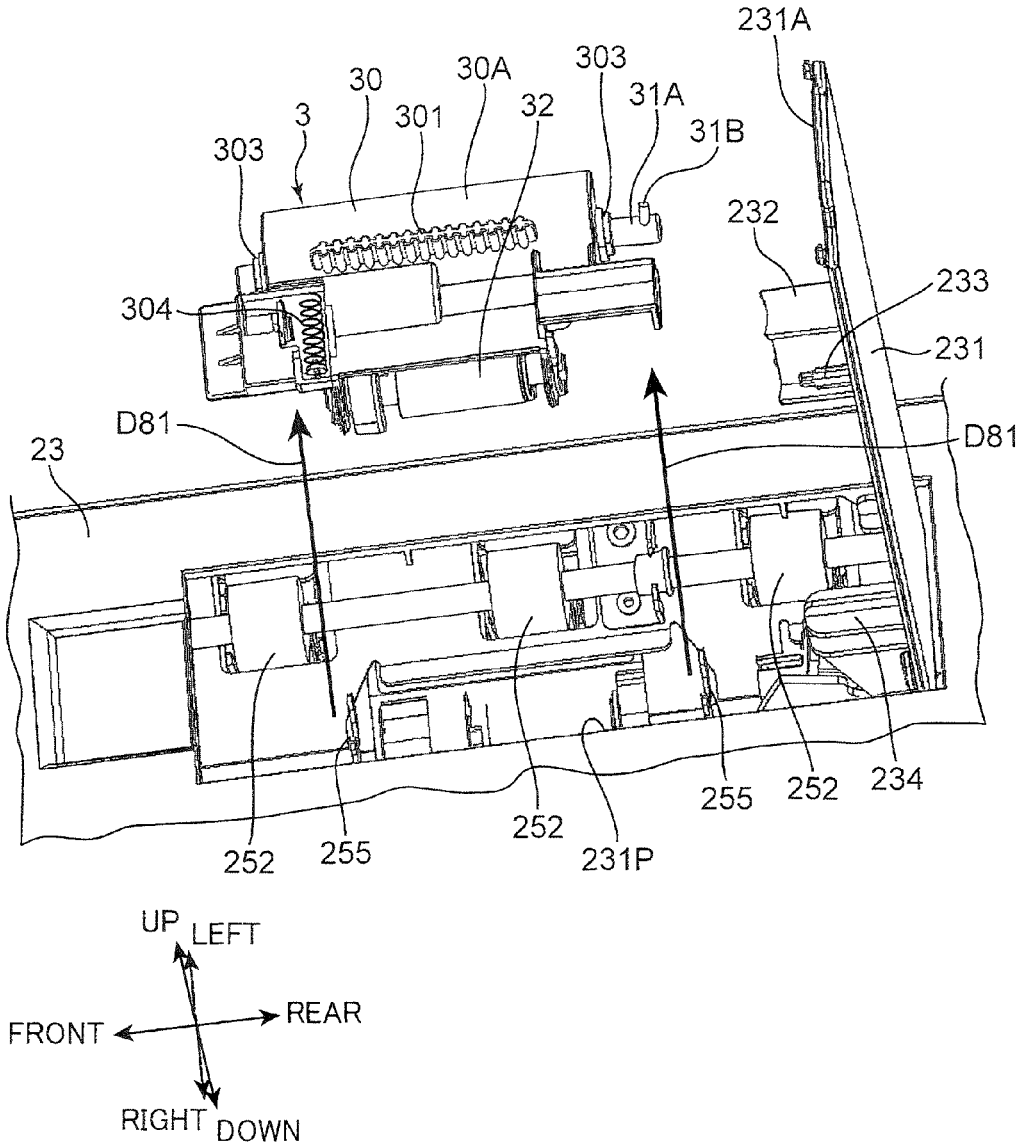
FIG. 8 is an enlarged perspective view showing a state where the sheet feeding unit according to the one embodiment of the present disclosure is removed from an apparatus main body.
Figure 9:
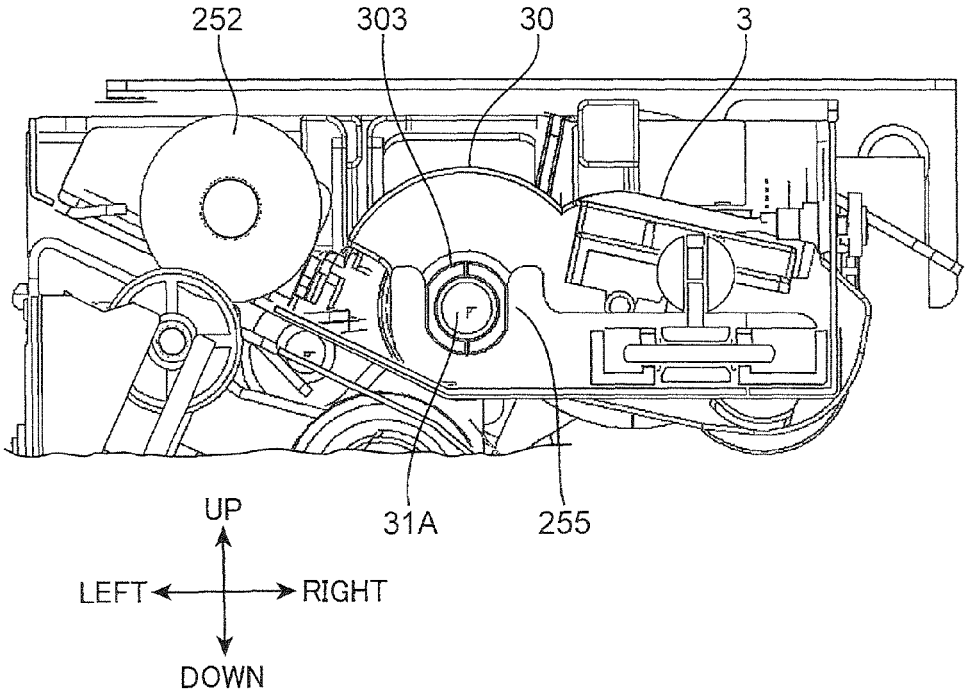
FIG. 9 is an enlarged sectional view showing the sheet feeding device of the sheet conveying apparatus according to one embodiment of the present disclosure.
Figure 10:
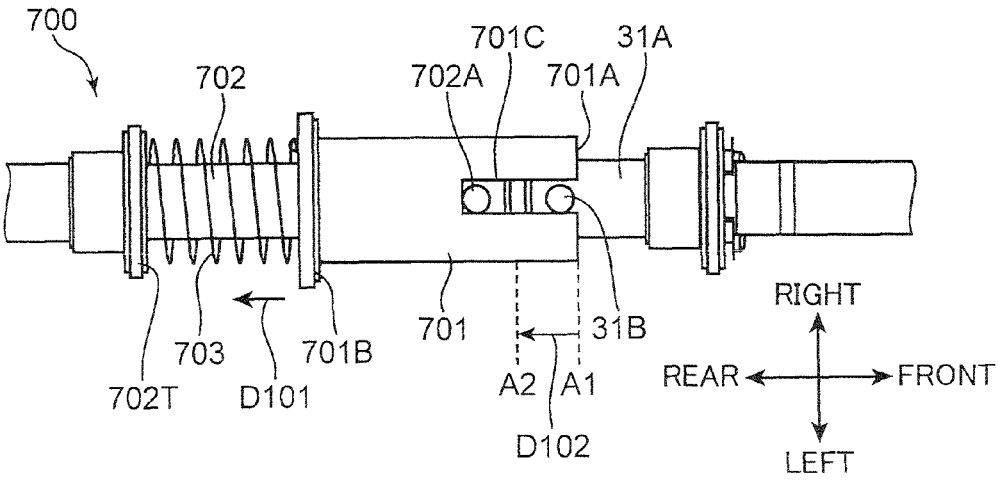
FIG. 10 is an enlarged view of a part where a drive force is transmitted to the sheet feeding unit.

Hereinafter, an embodiment of the present disclosure is described in detail with reference to the drawings. FIG. 1 is a perspective view of aside deck 1 (sheet conveying apparatus) according to one embodiment of the present disclosure. FIG. 2 is a sectional perspective view showing the internal structure of the side deck 1. FIG. 3 is a sectional view showing the internal structure of the side deck 1. FIG. 4 is an enlarged sectional view of a sheet feeding device which is an essential part of the side deck 1. FIG. 5 is a sectional view showing the arrangement of a sheet feeding unit 3 in the side deck 1. FIG. 6 is a sectional perspective view showing the arrangement of the sheet feeding unit 3. FIG. 7 are plan views showing a state where the sheet feeding unit 3 is exposed as an opening/closing cover 231 is opened and closed. FIG. 8 is an enlarged perspective view showing a state where the sheet feeding unit 3 is removed from a casing 2. FIG. 9 is an enlarged sectional view showing the sheet feeding device of the side deck 1. FIG. 10 is an enlarged view of a part where a drive force is transmitted in the sheet feeding unit 3.

The side deck 1 has sheets stacked therein and conveys the stacked sheets one by one in a predetermined direction. The side deck 1 according to this embodiment is, for example, coupled to an apparatus main body of a known image forming apparatus for forming an image on a sheet. At this time, the side deck 1 can be used as a so-called extended sheet tray. The sheet conveyed from the side deck 1 is conveyed in the image forming apparatus and an image is formed on the sheet in an image forming unit adopting a known electrophotographic technology or ink-jet technology.

The side deck 1 includes a casing 2 having a substantially rectangular parallelepipedic casing structure. The casing 2 includes a front surface portion 21, a left surface portion 22, an upper surface portion 23 and an internal space 25.

The front surface portion 21 defines the front surface of the casing 2. The front surface portion 21 is openable and closable with respect to the casing 2 about an unillustrated shaft portion. When the front surface portion 21 is opened, the internal space 25 formed in the casing 2 is exposed to the outside of the casing 2 as shown in FIG. 2.

The left surface portion 22 defines the left side surface of the casing 2. The left surface portion 22 includes a discharge opening 221 and connecting portions 222. The discharge opening 221 is an opening formed in an upper part of the left surface portion 22 to have a slight height in a vertical direction and extend in forward and backward directions. The connecting portions 222 are a pair of projecting pieces projecting leftward from the left surface portion 22 below the discharge opening 221. In coupling the side deck 1 to the apparatus main body of the image forming apparatus as described above, the connecting portions 222 are inserted into unillustrated insertion portions arranged in the apparatus main body. As a result, the side deck 1 and the apparatus main body of the image forming apparatus are coupled. Then, sheets are conveyed into the apparatus main body from the side deck 1 through the discharge opening 221.

The upper surface portion 23 defines the upper surface of the casing 2. The upper surface portion 231 includes the opening/closing cover 231. The opening/closing cover 231 is openable and closable with respect to the casing 2.

Further, the side deck 1 includes a tray 251 (sheet placing portion), the sheet feeding unit 3, a conveyor roller 252 and a facing roller 253.

The tray 251 is a plate-like member horizontally arranged in the internal space 25 of the casing 2. Sheets are placed on the upper surface of the tray 251. The tray 251 is made movable in the vertical direction by an unillustrated moving unit. At this time, the tray 251 is moved upward up to a position where the uppermost one of the sheets placed on the tray 251 faces a pickup roller 32 to be described later.

The sheet feeding unit 3 is arranged at a left upper position in the internal space 25 of the casing 2. The sheet feeding unit 3 is arranged to face the sheets on the tray 251. Further, as shown in FIG. 5, the sheet feeding unit 3 is arranged substantially in a central part in forward and backward directions of the casing 2. With reference to FIG. 4, the sheet feeding unit 3 includes a housing 30 (cover member), a feed roller 31 (sheet feeding member) and the pickup roller 32.

The housing 30 is arranged to cover the feed roller 31 and the pickup roller 32 from above and rotatably supports the feed roller 31 and the pickup roller 32.

The pickup roller 32 feeds the sheets placed on the tray 251 in a sheet conveying direction toward the discharge opening 221. The pickup roller 32 has a cylindrical shape. The pickup roller 32 is rotated in a direction of an arrow D4 of FIG. 4 by an unillustrated rotating unit to be brought into contact with the sheet. A rotational drive force is transmitted to the pickup roller 32 from a shaft 31A of the feed roller 31 to be described later via an unillustrated idler gear. At this time, the pickup roller 32 is rotated clockwise in FIG. 4.

The feed roller 31 is driven and rotated and further conveys the sheet fed from the pickup roller 32 toward the discharge opening 221 (in a predetermined direction). The feed roller 31 has a cylindrical shape similarly to the pickup roller 32. The feed roller 31 includes the shaft 31A (first rotary shaft). The shaft 31A is a rotational drive system of the feed roller 31. The shaft 31A is a rotary shaft extending in an axial direction from a cylindrical body part of the feed roller 31. The shaft 31A extends in a direction intersecting with a removing direction of the sheet feeding unit 3. A rotational drive force is transmitted to the shaft 31A from a driving unit 700 to be described later, whereby the feed roller 31 is rotated clockwise in FIG. 4.

The conveyor roller 252 is arranged downstream of the feed roller 31 in the sheet conveying direction. The conveyor roller 252 is arranged between the feed roller 31 and the discharge opening 221. The conveyor roller 252 further conveys the sheet conveyed by the feed roller 31 toward the discharge opening 221. The sheet is discharged to the outside of the discharge opening 221 by the conveyor roller 252.

The facing roller 253 is arranged to face the feed roller 31 from below the feed roller 31. A sheet feeding nip portion is formed between the facing roller 253 and the feed roller 31. The facing roller 253 is driven and rotated clockwise in FIG. 4 by an unillustrated driving unit. Specifically, the feed roller 31 and the facing roller 253 are rotated in opposite directions in the sheet feeding nip portion where these rollers face each other. As a result, the uppermost one of the sheets placed on the tray 251 is conveyed one by one toward the discharge opening 221.

As described above, the feed roller 31 and the pickup roller 32 are arranged near the sheets stacked on the tray 251 and convey the sheets toward the discharge opening 221. Thus, paper powder is likely to adhere to the circumferential surfaces of the feed roller 31 and the pickup roller 32. If a quantity of powder adheres to the roller circumferential surfaces, sheet conveying performance may be deteriorated. Thus, in this embodiment, the sheet feeding unit 3 including the feed roller 31 and the pickup roller 32 is made easily mountable into and removable from the casing 2. As a result, the feed roller 31 and the pickup roller 32 are easily cleaned and the sheet feeding unit 3 is easily exchanged by a user of the side deck 1.

With reference to FIGS. 6 to 8, the sheet feeding unit 3 is mountable into and removable from the internal space 25 (FIG. 2) of the casing 2 (arrows D81 of FIG. 8) by opening and closing the opening/closing cover 231. With reference to FIG. 6, the opening/closing cover 231 is a rectangular plate-like member having front, rear, left and right sides. The opening/closing cover 231 is opened and closed to vertically move a holding portion 231A on the front side with a base end portion 231B on the rear end as a supporting point (arrows D61 of FIG. 6). If the opening/closing cover 231 is opened (arrow D71 of FIG. 7), the sheet feeding unit 3 is exposed to the outside of the casing 2 through a rectangular opening 231P (FIGS. 7, 8) formed in the upper surface portion 23 of the casing 2. In other words, the opening/closing cover 231 is openably and closably arranged on the casing 2 to cover the opening 231P. The opening/closing cover 231 and the opening 231P cause the sheet feeding unit 3 to be exposed to the outside of the casing 2 in an open state of the opening/closing cover 231.

With reference to FIGS. 8 and 9, the sheet feeding unit 3 includes a grip portion 301, insertion portions 303 and a biasing spring 304. Further, bearing mounting portions 255 are arranged in the internal space 25 of the casing 2. Further, a pressing portion 232, a spring supporting portion 233 and a canceling piece 234 are arranged on an inner wall part of the opening/closing cover 231.

The grip portion 301 (holding portion) is arranged in forward and backward directions on the upper end of the housing 30. The user can mount and remove the sheet feeding unit 3 by holding the grip portion 301. The grip portion 301 is arranged to face the opening 231P.

The insertion portions 303 (bearing portion) are a pair of bearing portions arranged on opposite end sides of the feed roller 31 arranged in the sheet feeding unit 3. The insertion portions 303 are provided on the housing 30. The shaft 31A of the feed roller 31 is inserted through the insertion portions 303. Each insertion portion 303 has such a thin cylindrical shape that left and right parts of the outer circumferential surface are vertically cut (FIG. 9).

The biasing spring 304 is a spring member extending upward from a front part of the upper surface of the housing 30. When the opening/closing cover 231 is closed, the biasing spring 304 is pressed by the spring supporting portion 233 of the opening/closing cover 231 to be described later. As a result, a front part of the sheet feeding unit 3 is stably maintained in position in the vertical direction.

A pair of bearing mounting portions 255 are arranged to face the insertion portions 303 of the sheet feeding unit 3 in the internal space 25 of the casing 2 and the pair of bearing mounting portions 255 are arranged to be mounted the pair of insertion portions 303 thereon. As shown in FIG. 9, the bearing mounting portions 255 have a substantially U shape open upward.

The pressing portion 232 projects toward the internal space 25 from an inner wall part of the opening/closing cover 231. When the opening/closing cover 231 is closed, the pressing portion 232 presses a pressed portion 30A of the housing 30 downward. As a result, the sheet feeding unit 3 is stably mounted in the internal space 25.

The spring supporting portion 233 projects from the inner wall part of the opening/closing cover 231 toward the internal space 25 on the right side of the pressing portion 232. The spring supporting portion 233 has a cylindrical shape. As described above, the spring supporting portion 233 presses the biasing spring 304 downward when the opening/closing cover 231 is closed.

The canceling piece 234 projects from the inner wall part of the opening/closing cover 231 toward the internal space 25 on the side of the base end portion 231B of the opening/closing cover 231. The canceling piece 234 constitutes a part of a drive transmission switching unit 7 to be described later. The canceling piece 234 has a function of canceling drive transmission to the feed roller 31 in association with opening and closing movements of the opening/closing cover 231. The canceling piece 234 is described in detail later.

In mounting the sheet feeding unit 3 into the internal space 25 of the casing 2, the insertion portions 303 of the sheet feeding unit 3 are vertically fitted into the bearing mounting portions 255. As a result, the sheet feeding unit 3 is mountable into and removable from the internal space 25 in directions intersecting with a plane of opening of the opening 231P (through the opening 231P). More specifically, in the open state of the opening/closing cover 231, the sheet feeding unit 3 is mountable and removable in the vertical direction through the opening 231P in the upper surface portion 23 of the casing 2. Thus, the sheet feeding unit 3 is easily exchangeable by the user. Specifically, an operator can mount and remove the sheet feeding unit 3 in directions intersecting with the plane of opening of the opening 231P while holding the grip portion 301 of the sheet feeding unit 3. Thus, the sheet feeding unit 3 is easily mounted and removed in a maximally simple operation procedure. Further, since the sheet feeding unit 3 is mounted and removed through the opening 231P, the operator can more easily mount and remove the sheet feeding unit 3 without bending low.

With reference to FIG. 7, the driving unit 700 is arranged in the internal space 25 (FIG. 2) of the casing 2. The driving unit 700 is coupled to the rotational drive system of the feed roller 31 and transmits a rotational drive force to the feed roller 31. Further, the rotational drive force is transmitted from the feed roller 31 to the pickup roller 32 by the unillustrated idler gear arranged between the feed roller 31 and the pickup roller 32. The driving unit 700 and the shaft 31A of the feed roller 31 are coupled to transmit the rotational drive force from the driving unit 700 to the feed roller 31.

As described above, the driving unit 700 and the shaft 31A of the feed roller 31 need to be uncoupled to remove the sheet feeding unit 3 from the internal space 25 of the casing 2. If the user performs this uncoupling operation, mounting/removing operations of the sheet feeding unit 3 become complicated and a rotation error of the feed roller 31 may occur due to a coupling error between the driving unit 700 and the shaft 31A. To solve such a problem, the driving unit 700 and the shaft 31A of the feed roller 31 are coupled and uncoupled in association with opening and closing movements of the opening/closing cover 231 in mounting and removing the sheet feeding unit 3 in this embodiment. More specifically, the drive transmission switching unit 7 to be described later performs the coupling and the uncoupling in association with opening and closing movements of the opening/closing cover 231. The sheet feeding unit 3 is mountable into and removable from the internal space 25 through the opening 231P in the uncoupled state.

With reference to FIGS. 7 and 10, the driving unit 700 is arranged to face the shaft 31A of the feed roller 31 in forward and backward directions and extends coaxially with the shaft 31A. The driving unit 700 includes a drive coupling portion 701 (cylindrical portion), a drive shaft 702 and a compression spring 703.

The drive shaft 702 is a drive shaft for transmitting the rotational drive force to the shaft 31A. Note that an unillustrated motor is connected to a rear end part of the drive shaft 702 in FIG. 10. When the sheet feeding unit 3 is mounted to the casing 2, the drive shaft 702 extends in the axial direction while being spaced apart from the shaft 31A of the feed roller 31 in forward and backward directions and is arranged coaxially with the shaft 31A while facing the shaft 31A. The drive shaft 702 includes a drive shaft projection 702A (second projection 31B) and a supporting portion 702T (wall portion). The drive shaft projection 702A projects in a radial direction of the drive shaft 702 from an end part of the outer circumferential surface of the drive shaft 702 on the side of the shaft 31A. The supporting portion 702T is a flange portion projecting in the radial direction of the drive shaft 702 from an outer peripheral part of the drive shaft 702 on a rear end side of the drive shaft 702. The supporting portion 702T is arranged to face a side surface (a end surface, flange portion 701B) of the drive coupling portion 701 to be described later on the drive shaft 702 opposite to the shaft 31A.

The drive coupling portion 701 is a cylindrical coupling member arranged coaxially with the drive shaft 702. The shaft 31A of the feed roller 31 is inserted into a front part of the drive coupling portion 701. Further, the drive shaft 702 is inserted into a rear part of the drive coupling portion 701. In other words, the shaft 31A and the drive shaft 702 are inserted into the drive coupling portion 701 in directions opposite to each other. The drive coupling portion 701 is fitted onto the drive shaft 702 slidably. The drive coupling portion 701 is integrally rotated with the drive shaft 702. Further, the shaft 31A is integrally rotated with the drive coupling portion 701 in a state where the shaft 31A and the driving unit 700 are coupled. The drive coupling portion 701 includes a leading end portion 701A, the flange portion 701B and a cut portion 701C. The leading end portion 701A is the front side surface of the drive coupling portion 701. The shaft 31A is inserted into the cylindrical interior of the drive coupling portion 701 through the leading end portion 701A. The flange portion 701B is arranged on the rear side surface of the drive coupling portion 701. The flange portion 701B is a flange portion connected consecutively to the rear side surface of the drive coupling portion 701 and radially projecting from an outer peripheral part of the drive coupling portion 701. The cut portion 701C is a cut portion formed by cutting the outer circumferential surface of the drive coupling portion 701 in the axial direction from an end edge on the side of the leading end portion 701A (end edge on the side of the shaft 31A). The drive shaft projection 702A of the drive shaft 702 is inserted into and engaged with the cut portion 701C, whereby the drive coupling portion 701 and the drive shaft 702 are integrally rotated.

The compression spring 703 (spring member) is compressively arranged between the supporting portion 702T and the flange portion 701B. When the drive coupling portion 701 is moved backward with respect to the drive shaft 702, the compression spring 703 is compressed between the supporting portion 7021 and the flange portion 701B. In other words, the compression spring 703 biases the flange portion 701B of the drive coupling portion 701 forward, toward the shaft 31A, with the supporting portion 702T as a base point. The drive shaft 702 is inserted into the compression spring 703.

On the other hand, the shaft 31A includes a shaft projection 31B (first projection 31B). The shaft projection 31B is a projection projecting in a radial direction of the shaft 31A from an end part of the outer circumferential surface of the shaft 31A on the side of the driving unit 700.

As shown in FIG. 10, the drive shaft 702 and the shaft 31A are coaxially arranged. The drive shaft 702 and the shaft 31A are arranged at a predetermined distance from each other. In a state where the drive coupling portion 701 is biased forward by the compression spring 703 (state where the leading end portion 701A is located at a position A1 of FIG. 10), the shaft projection 31B of the shaft 31A is inserted into the cut portion 701C of the drive coupling portion 701. Specifically, the shaft projection 31B is engaged with the cut portion 701C. As a result, the rotational drive force can be transmitted from the drive shaft 702 to the shaft 31A via the drive coupling portion 701 and the shaft 31A is integrally rotated with the drive shaft 702.

On the other hand, when the drive coupling portion 701 is moved backward slidably (arrow D102 of FIG. 10) while the compression spring 703 is compressed (arrow D101 of FIG. 10), the leading end portion 701A is arranged at a position A2 of FIG. 10 and the shaft projection 31B of the shaft 31A is separated from the cut portion 701C of the drive coupling portion 701. As a result, the transmission of the rotational drive force from the driving unit 700 to the shaft 31A is cut off. In other words, the driving unit 700 and the feed roller 31 are uncoupled (state of FIG. 7B). As a result, the sheet feeding unit 3 is mountable into and removable from the internal space 25 of the casing 2. As just described, in this embodiment, the shaft 31A and the driving unit 700 are separated in the axial direction, whereby the driving unit 700 and the feed roller 31 are uncoupled. Thus, mounting and removing movements of the sheet feeding unit 3 in the vertical direction are not hindered by the driving unit 700. Further, the rotational drive force to the feed roller 31 is preferably cut off by an axial movement of the drive coupling portion 701. Further, the drive coupling portion 701 and the shaft 31A can be uncoupled with the drive coupling portion 701 and the drive shaft 702 kept engaged. Furthermore, the cut portion 701C and the shaft projection 31B can be engaged again by a restoring force of the compression spring 703.

Next, modes of coupling and uncoupling the driving unit 700 and the shaft 31A in association with opening and closing movements of the opening/closing cover 231 in this embodiment are described in more detail.

Figure 11:
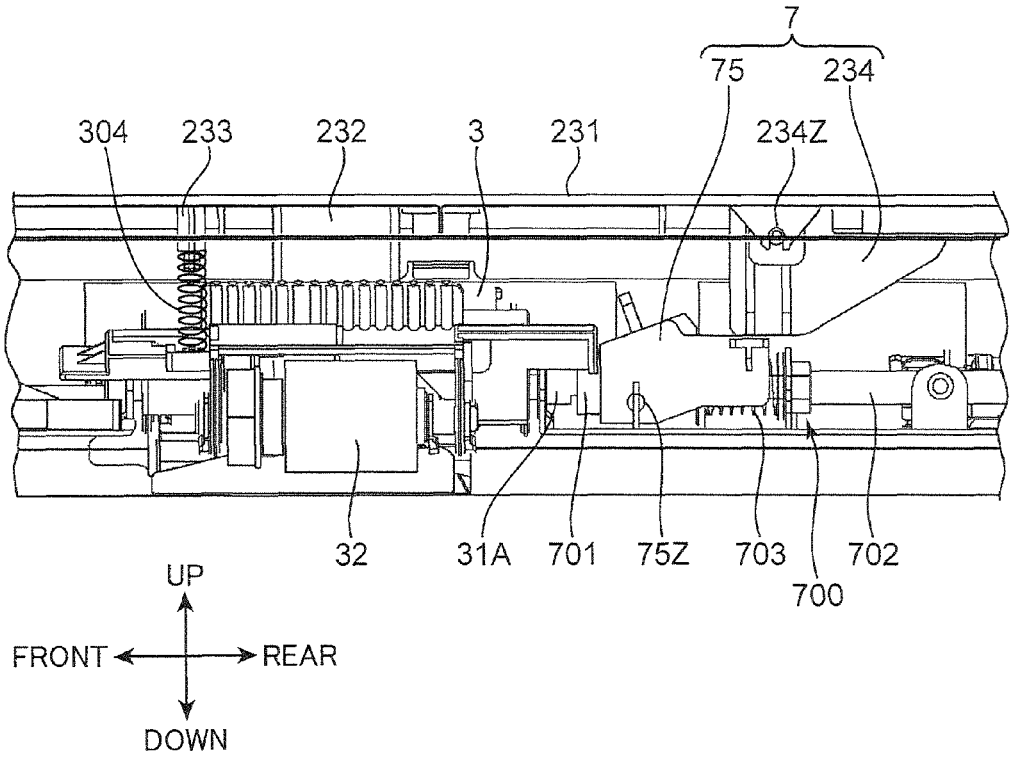
FIG. 11 is a side view showing the periphery of the sheet feeding unit in a state where the opening/closing cover is closed when viewed from right.
Figure 12:
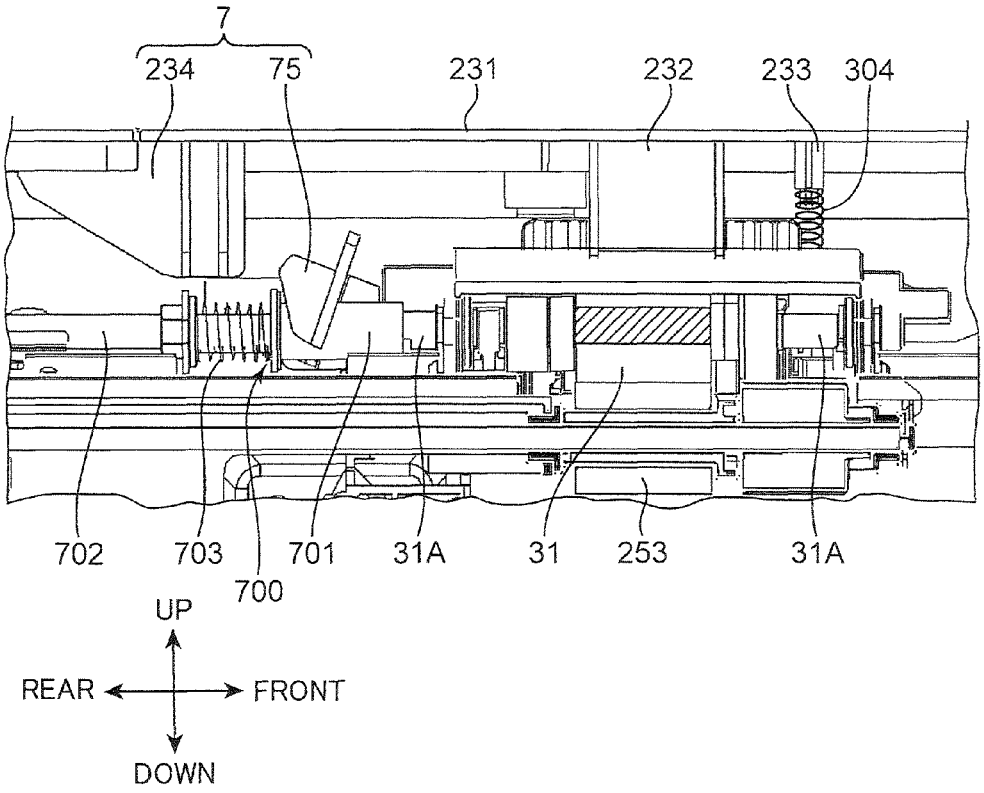
FIG. 12 is a side view in section showing the periphery of the sheet feeding unit in the state where the opening/closing cover is closed when viewed from left.
Figure 13:
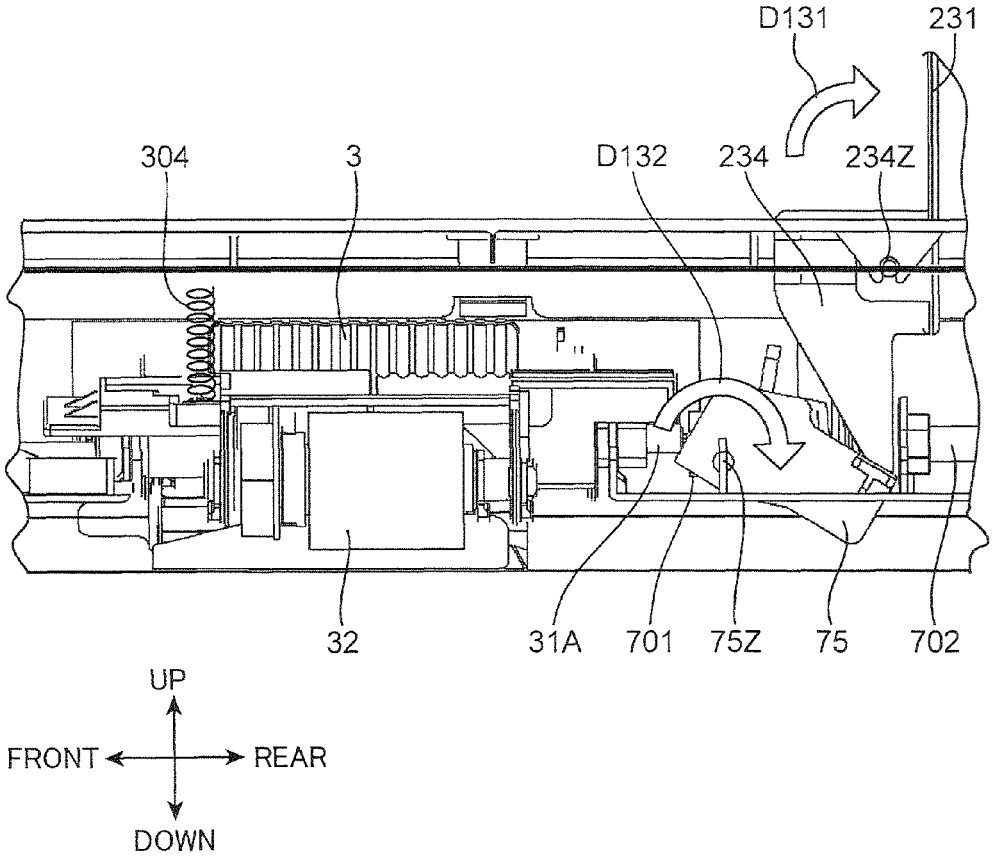
FIG. 13 is a side view showing the periphery of the sheet feeding unit in a state where the opening/closing cover is opened when viewed from right.
Figure 14:
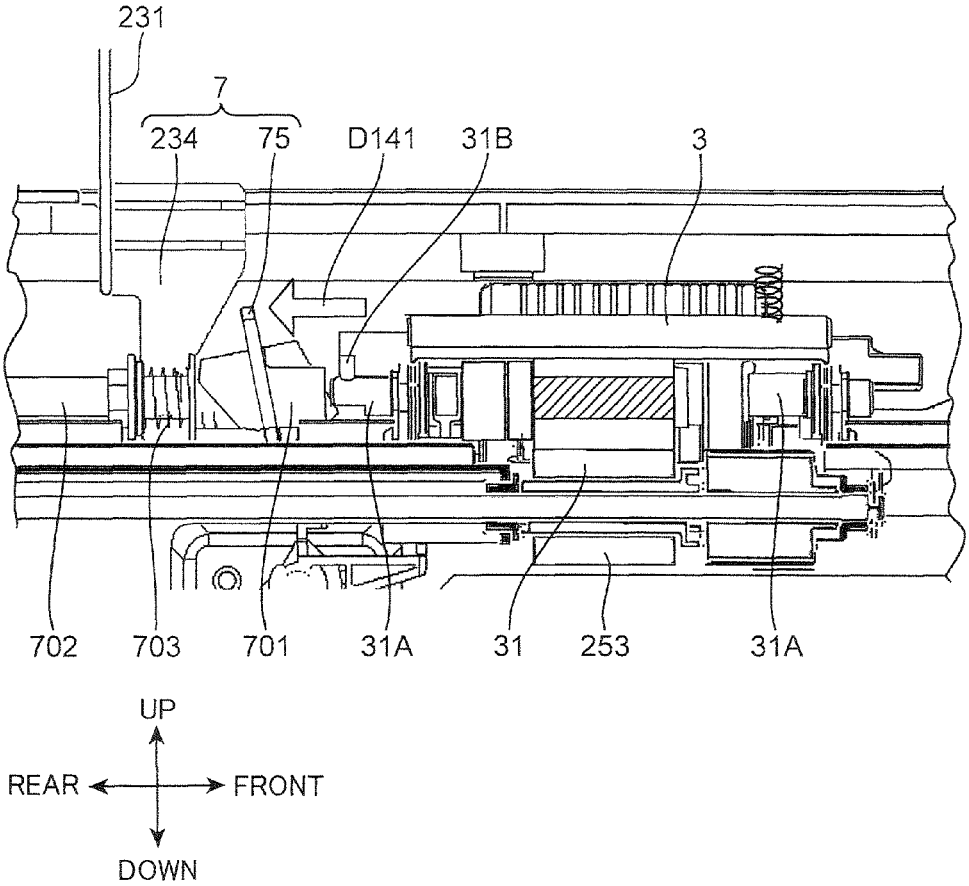
FIG. 14 is a side view in section showing the periphery of the sheet feeding unit in the state where the opening/closing cover is opened when viewed from left.
Figure 15:
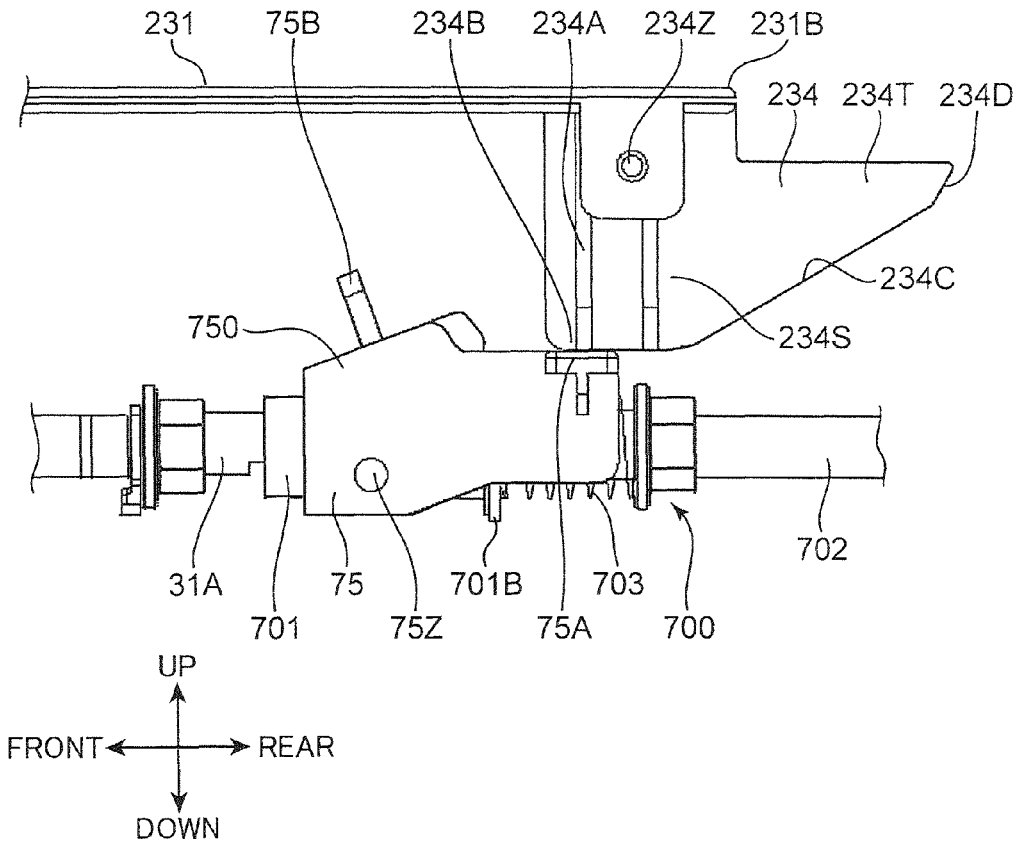
FIG. 15 is a side view showing the periphery of a drive force transmitting unit in the state where the opening/closing cover is closed when viewed from right.
Figure 16:
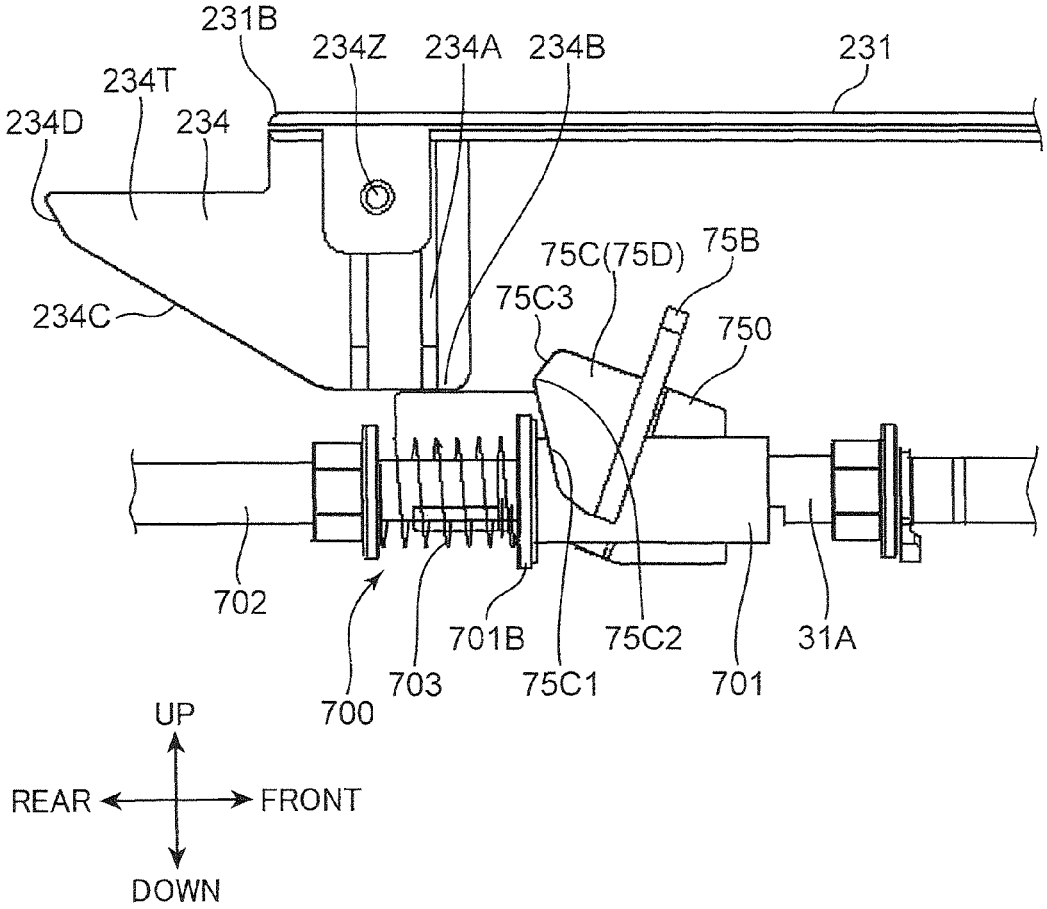
FIG. 16 is a side view showing the periphery of the drive force transmitting unit in the state where the opening/closing cover is closed when viewed from left.
Figure 17:
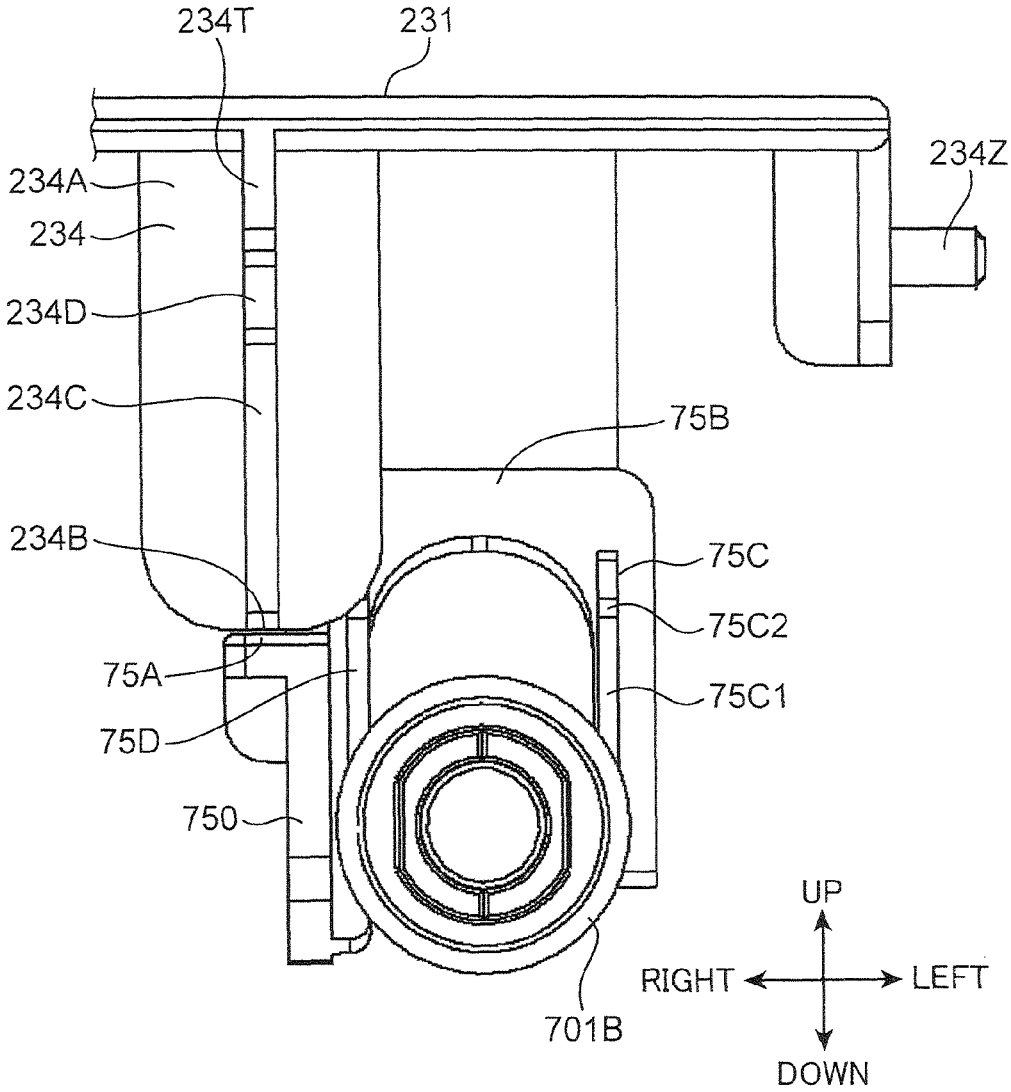
FIG. 17 is a side view showing the periphery of the drive force transmitting unit in the state where the opening/closing cover is closed when viewed from behind.
Figure 18:
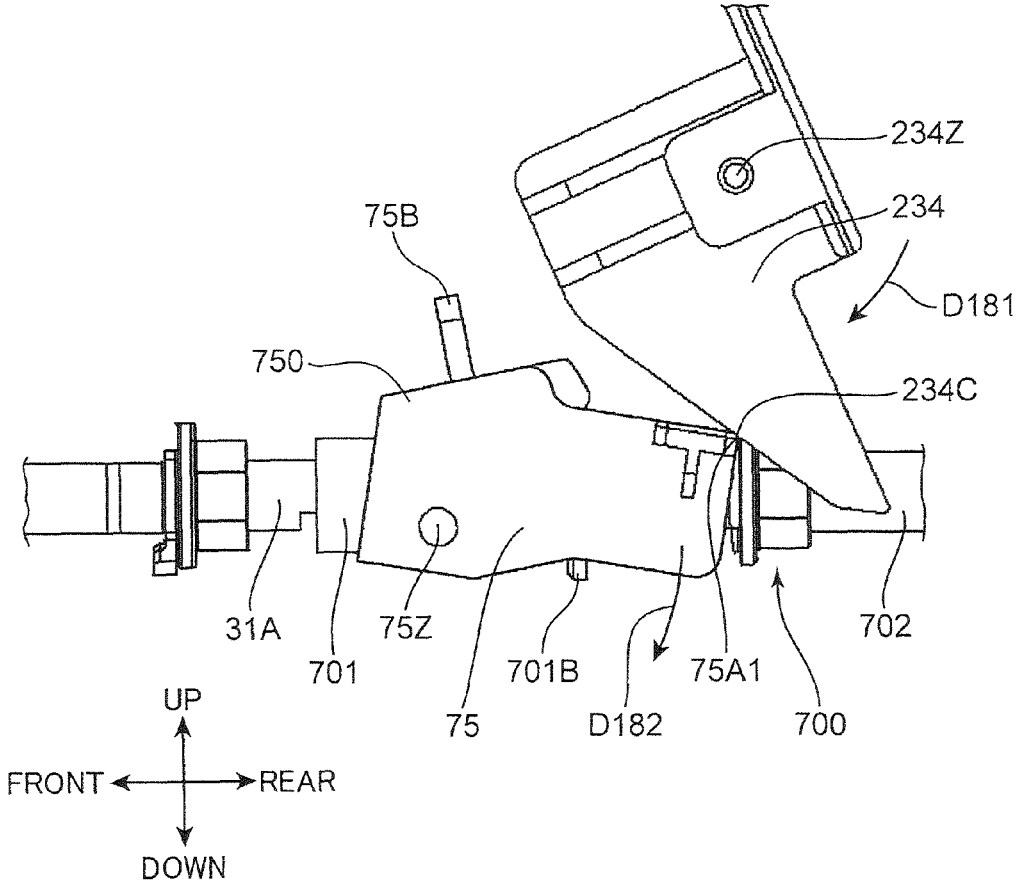
FIG. 18 is a side view showing the periphery of the drive force transmitting unit in a state where the opening/closing cover is being opened when viewed from right.
Figure 19:
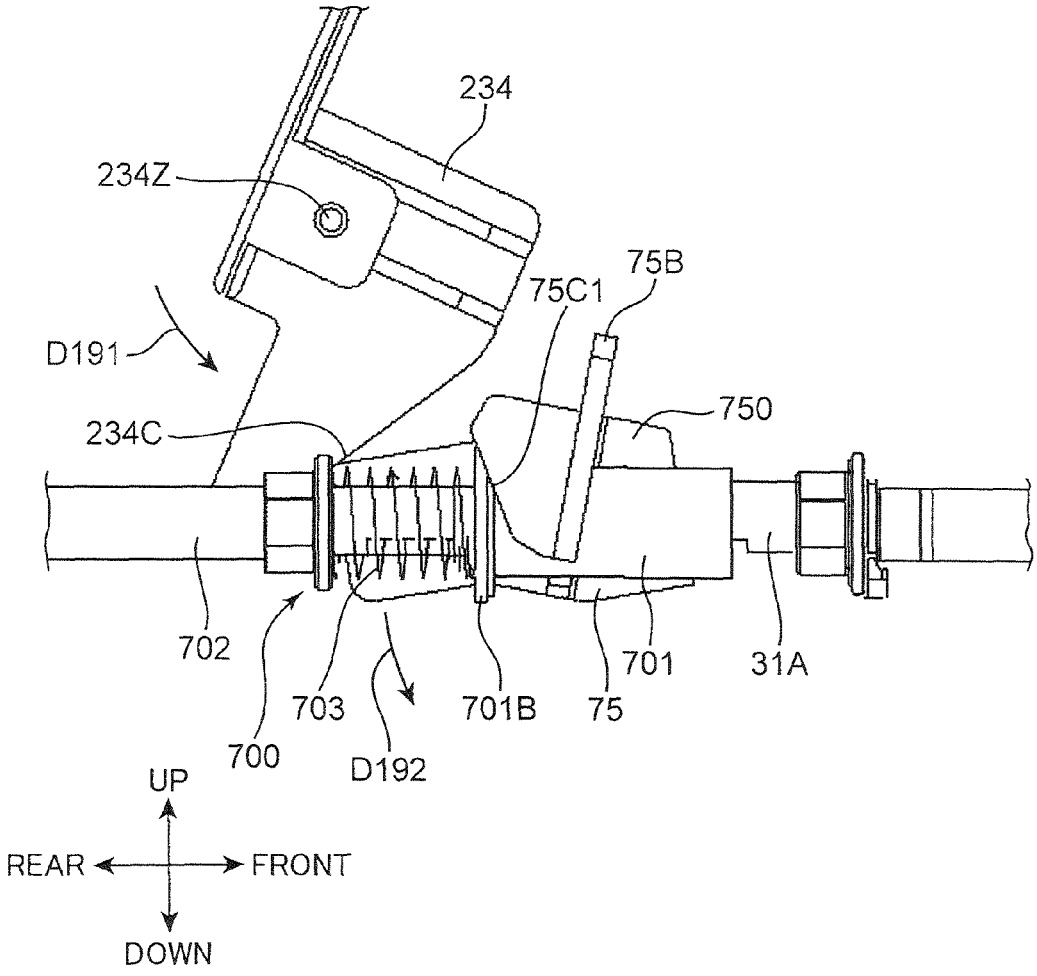
FIG. 19 is a side view showing the periphery of the drive force transmitting unit in the state where the opening/closing cover is being opened when viewed from left.
Figure 20:
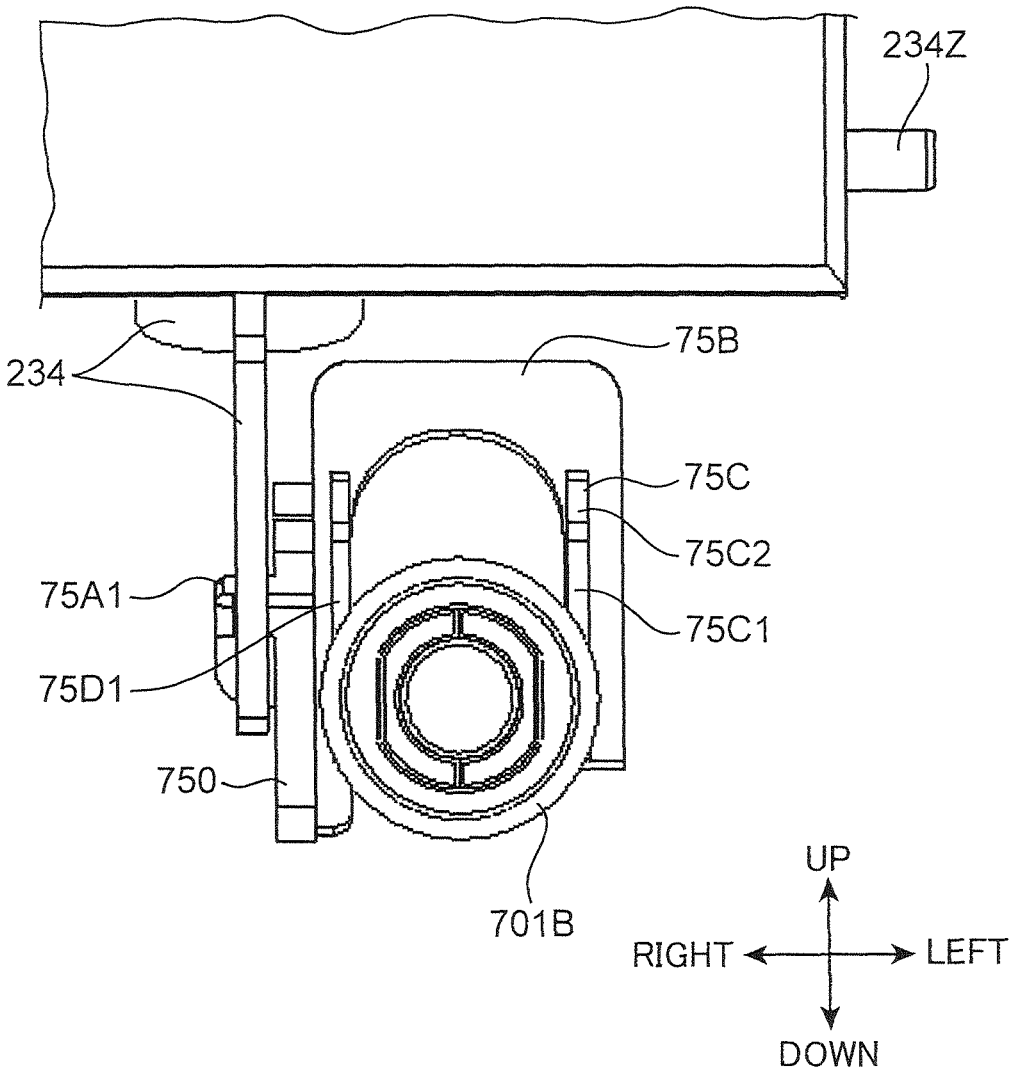
FIG. 20 is a side view showing the periphery of the drive force transmitting unit in the state where the opening/closing cover is being opened when viewed from behind.
Figure 21:
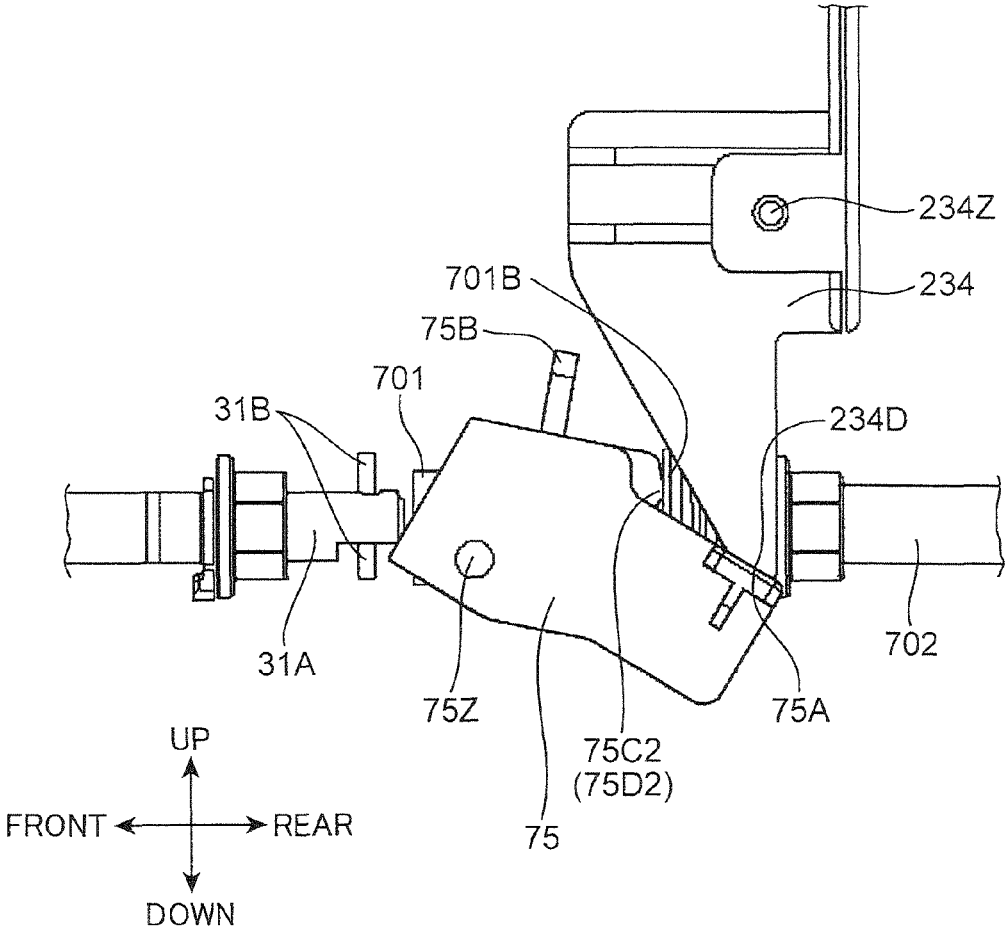
FIG. 21 is a side view showing the periphery of the drive force transmitting unit in a state where the opening/closing cover is completely opened when viewed from right.
Figure 22:
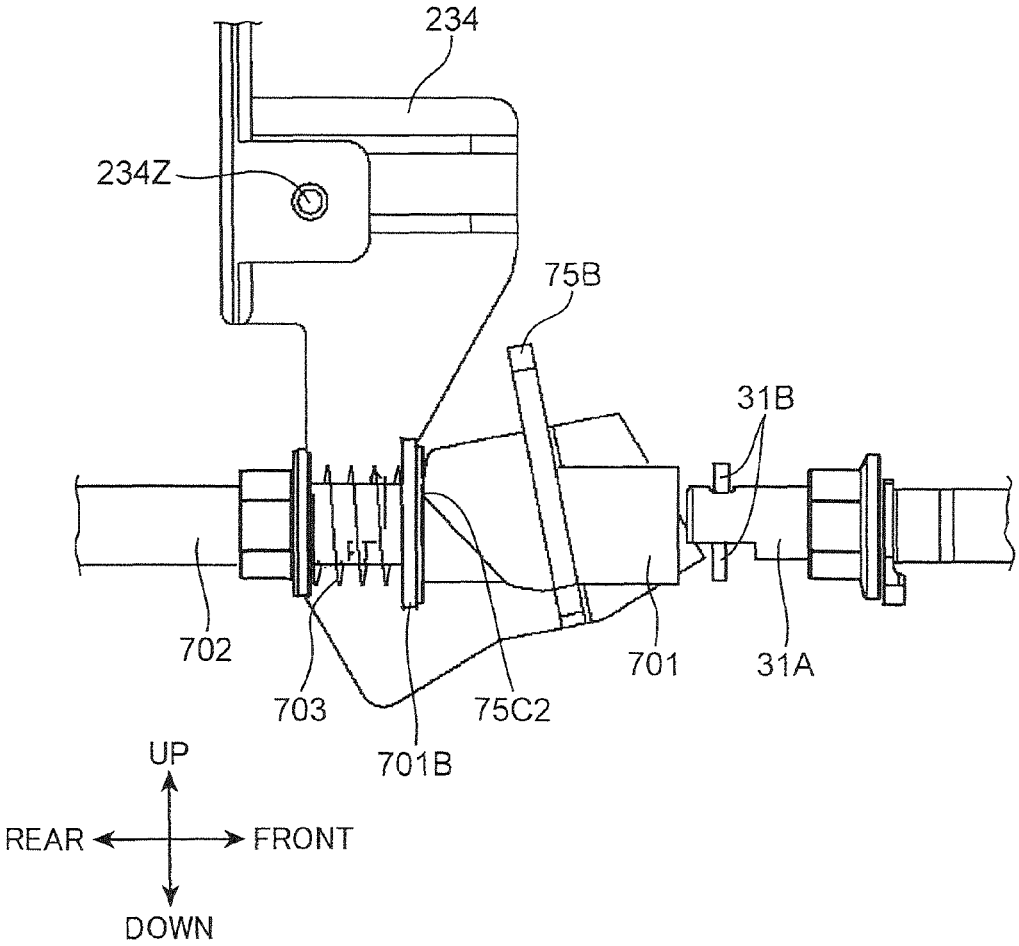
FIG. 22 is a side view showing the periphery of the drive force transmitting unit in the state where the opening/closing cover is completely opened when viewed from left.
Figure 23:
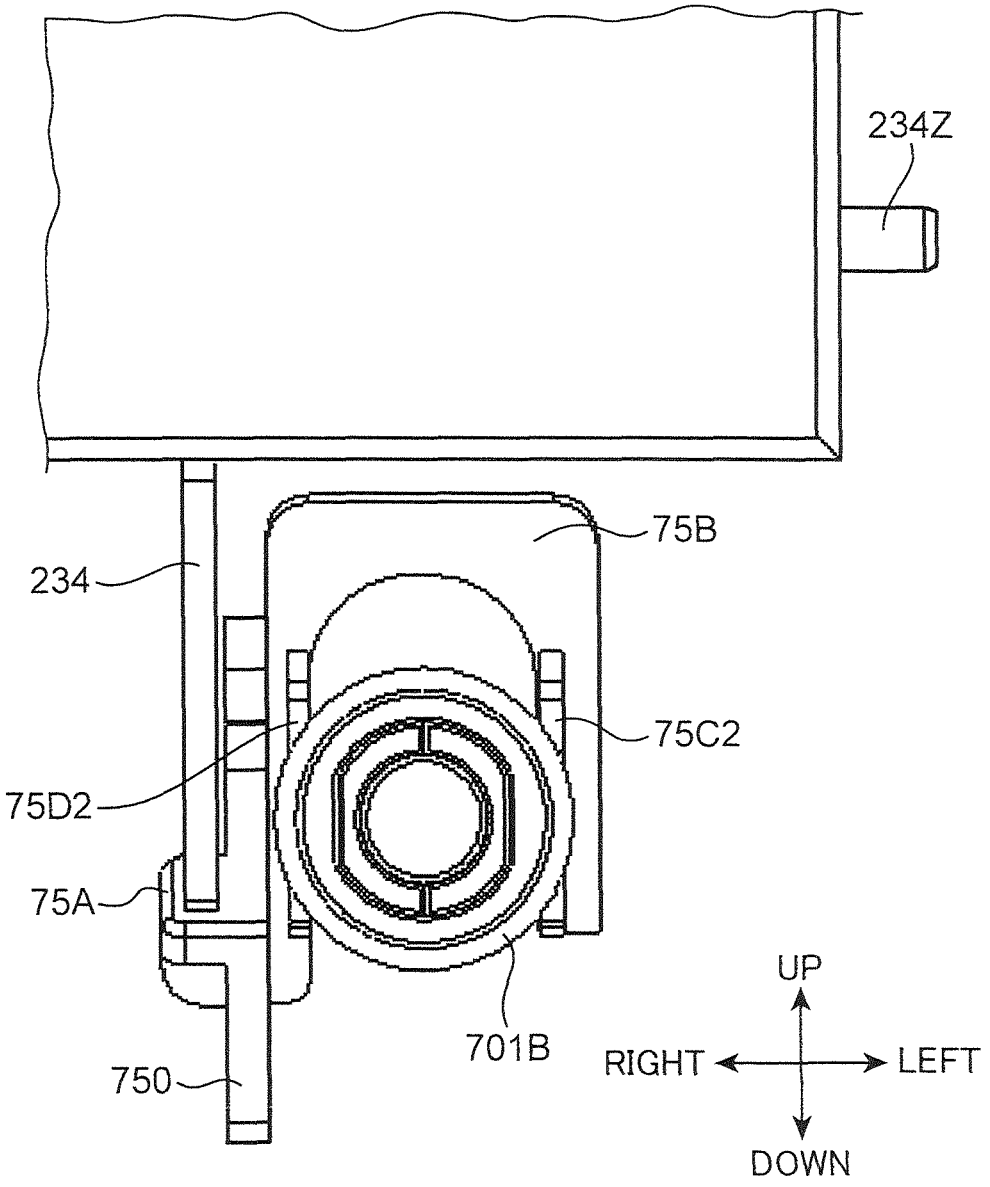
FIG. 23 is a side view showing the periphery of the drive force transmitting unit in the state where the opening/closing cover is completely opened when viewed from behind.

FIG. 11 is a side view showing the periphery of the sheet feeding unit 3 and the driving unit 700 in the internal space 25 of the casing 2 when viewed from right. FIG. 12 is a side view showing the periphery of the sheet feeding unit 3 and the driving unit 700 when viewed from left. FIGS. 11 and 12 show a state where the opening/closing cover 231 is closed. Similarly, FIG. 13 is a side view showing the periphery of the sheet feeding unit 3 and the driving unit 700 in the internal space 25 of the casing 2 when viewed from right. FIG. 14 is a side view showing the periphery of the sheet feeding unit 3 and the driving unit 700 when viewed from left. FIGS. 13 and 14 show a state where the opening/closing cover 231 is opened. FIG. 15 is a right side view enlargedly showing parts of the sheet feeding unit 3 and the driving unit 700 in the state where the opening/closing cover 231 is closed. FIG. 16 is a left side view showing the state of FIG. 15. FIG. 17 is a view showing the state of FIG. 15 when viewed from behind. FIG. 18 is a right side view enlargedly showing parts of the sheet feeding unit 3 and the driving unit 700 in a state where the opening/closing cover 231 is opened by about 60° with respect to the upper surface portion 23. FIG. 19 is a left side view showing the state of FIG. 18. FIG. 20 is a view showing the state of FIG. 18 when viewed from behind. FIG. 21 is a right side view enlargedly showing parts of the sheet feeding unit 3 and the driving unit 700 in a state where the opening/closing cover 231 is completely opened. FIG. 22 is a left side view showing the state of FIG. 21. FIG. 23 is a view showing the state of FIG. 21 when viewed from behind.

In this embodiment, the driving unit 700 and the sheet feeding unit 31 are coupled and uncoupled by the drive transmission switching unit 7 (drive switching unit) arranged in the casing 2. Particularly, the drive transmission switching unit 7 uncouples the driving unit 700 and the feed roller 31 in association with a change (switching movement) from the closed state to the open state of the opening/closing cover 231. Further, the drive transmission switching unit 7 couples the driving unit 700 and the feed roller 31 in association with a change from the open state to the closed state of the opening/closing cover 231. Thus, the operator can easily mount and remove the sheet feeding unit 3.

The drive transmission switching unit 7 includes the aforementioned canceling piece 234 and an uncoupling member 75 (FIG. 11). The drive transmission switching unit 7 uncouples the driving unit 700 and the rotational drive system of the feed roller 31 by separating the shaft 31A and the driving unit 700 in the axial direction of the shaft 31A. Particularly, the drive transmission switching unit 7 separates the driving unit 700 from the shaft 31A by moving the drive coupling portion 701 in the axial direction to separate the shaft projection 31B from the cut portion 701C.

With reference to FIGS. 15 to 17, the canceling piece 234 is arranged at the inner side of the base end portion 231B of the opening/closing cover 231. The canceling piece 234 includes a canceling piece base plate portion 234A, a canceling piece main portion 234S and a canceling piece projecting portion 234T.

The canceling piece base plate portion 234A is a plate-like member having a predetermined width in the lateral direction and projecting toward the internal space 25 from the inner wall part of the opening/closing cover 231.

The canceling piece main portion 234S is a plate-like member extending to intersect with the canceling piece base plate portion 234A. The canceling piece main portion 234S has a rectangular shape intersecting with the canceling piece base plate portion 234A. In the closed state of the opening/closing cover 231 shown in FIG. 15, a canceling piece contact portion 234B is arranged on the front lower corner of the canceling piece main portion 2345. The canceling piece contact portion 234B can come into contact with an uncoupling member contact portion 75A of the uncoupling member 75 to be described later.

The canceling piece projecting portion 234T is a projecting piece connected to the canceling piece main portion 234S and projecting toward the back side of the opening/closing cover 231. The canceling piece projecting portion 234T has a substantially right triangular shape and includes an inclined portion inclined upward to the back in the closed state of the opening/closing cover 231 as shown in FIGS. 15 and 16. The inclined portion is composed of two inclined portions (first inclined portion 234C, second inclined portion 234D) inclined at different angles. The first and second inclined portions 234C, 234D can come into contact with the uncoupling member contact portion 75A of the uncoupling member 75 to be described later.

The canceling piece 234 (second contact member) is rotated about a canceling piece shaft portion 234Z in opening and closing the opening/closing cover 231. Specifically, the opening/closing cover 231 is rotatably supported on the canceling piece shaft portion 234Z extending in a direction intersecting with the shaft 31A in the casing 2 and one end of the opening/closing cover 231 is rotated about the canceling piece shaft portion 234Z, whereby the state of the opening/closing cover 231 can be changed between the open state and the closed state. In this embodiment, the canceling piece 234 is integrally rotated with the opening/closing cover 231. At this time, in the closed state of the opening/closing cover 231, the canceling piece projecting portion 234T of the canceling piece 234 extends along the inner wall surface of the opening/closing cover 231 (upper surface portion 23). On the other hand, the canceling piece projecting portion 234T of the canceling piece 234 is moved to project into the internal space 25 as the state of the opening/closing cover 231 changes from the closed state to the open state (FIG. 13).

The uncoupling member 75 (rotating member) is arranged adjacent to the drive coupling portion 701 of the driving unit 700. The uncoupling member 75 includes a rotating plate 750 (base plate portion), the uncoupling member contact portion 75A (contacted portion), an arch portion 75B (FIGS. 16, 17), a first projecting piece 75C (first contact member) and a second projecting piece 75D (first contact member). The structure of the uncoupling member 75 in the closed state of the opening/closing cover 231 is described below with reference to FIGS. 15 to 17.

The rotating plate 750 is a main part of the uncoupling member 75. The rotating plate 750 is arranged along the drive coupling portion 701 (drive shaft 702) on the right side of the drive coupling portion 701. The rotating plate 750 is a plate-like member having a predetermined width in the vertical direction and extending in forward and backward directions. The rotating plate 750 includes an uncoupling member shaft portion 75Z (second rotary shaft). The uncoupling member shaft portion 75Z is a rotary shaft arranged on a lower front part of the rotating plate 750. Further, the uncoupling member shaft portion 75Z is a rotary shaft extending in a direction intersecting with the drive shaft 702 (in a direction intersecting with a moving direction of the drive coupling portion 701) in the casing 2. The uncoupling member 75 is rotatable about the uncoupling member shaft portion 75Z in planes of rotation in the vertical direction and forward and backward directions.

The uncoupling member contact portion 75A projects rightward on a rear upper part of the rotating plate 750. The uncoupling member contact portion 75A is a plate-like member facing in the vertical direction. The canceling piece contact portion 234B, the first inclined portion 234C and the second inclined portions 234D of the canceling piece 234 described above can come into contact with the uncoupling member contact portion 75A.

The arch portion 75B is arranged to project leftward from the rotating plate 750 so as to intersect with the rotating plate 750. With reference to FIGS. 16 and 17, the arch portion 75B is arranged to cover the left, right and upper sides of the drive coupling portion 701. The first and second projecting pieces 75C, 75D are respectively projecting pieces projecting backward from the arch portion 75B on the left and right sides of the drive coupling portion 701. Note that, as shown in FIG. 16, the arch portion 75B is inclined forward with respect to the axial direction of the drive coupling portion 701 in the closed state of the opening/closing cover 231.

With reference to FIG. 16, the first projecting piece 75C includes an 11th contact portion 75C1, a 12th contact portion 75C2 and an upper side portion 75C3. The first projecting piece 75C is connected to the rotating plate 750 and arranged to be able to come into contact with the flange portion 701B. The 11th contact portion 75C1 and the upper side portion 75C3 are oblique portions arranged to intersect with each other on a rear end part of the first projecting piece 75C. Particularly, the 11th contact portion 75C1 is arranged to face the flange portion 701B of the drive coupling portion 701. Further, the 12th contact portion 75C2 corresponds to an upper end part of the 11th contact portion 75C1 and a corner part where the 11th contact portion 75C1 and the upper side portion 75C3 intersect. Note that, as shown in FIG. 17, the 11th contact portion 75C1 is arranged to face an outer peripheral part of the flange portion 701B of the drive coupling portion 701 located at a leftmost position in forward and backward directions. Further, although not shown in FIG. 16, unillustrated 21st contact portion, 22nd contact portion and upper side portion shaped similarly to the corresponding components of the first projecting piece 75C are respectively arranged on the second projecting piece 75D.

Next, movements of the drive transmission switching unit 7 in association with the opening and closing (switching movements) of the opening/closing cover 231 are described in detail. With reference to FIGS. 11, 12 and 15 to 17, the canceling piece contact portion 234B of the canceling piece 234 is arranged to face the uncoupling member contact portion 75A of the uncoupling member 75 when the opening/closing cover 231 is closed with respect to the upper surface portion 23 of the casing 2. At this time, the canceling piece contact portion 234B is slightly in contact with the uncoupling member contact portion 75A. Thus, the uncoupling member 75 hardly receives a pressing force from the canceling piece 234. The rotating plate 750 of the uncoupling member 75 extends in forward and backward directions along the drive shaft 702. Further, as shown in FIG. 16, the 11th contact portion 75C1 of the uncoupling member 75 is not in contact with the flange portion 701B of the drive coupling portion 701 (the same also holds for the unillustrated 21st contact portion). In other words, the 11th contact portion 75C1 is arranged at a first position distant from the drive coupling portion 701. As a result, the drive coupling portion 701 is located at a foremost position by a biasing force of the compression spring 703 (position A1 of FIG. 10). Accordingly, when the sheet feeding unit 3 is mounted to the casing 2, the drive shaft projection 702A and the shaft projection 31B are inserted into the cut portion 701C of the drive coupling portion 701 and the rotational drive force can be transmitted from the drive shaft 702 to the shaft 31A.

Contrary to this, if the user starts opening the opening/closing cover 231, the canceling piece 234 and the uncoupling member 75 are set in states as shown in FIGS. 18 to 20. Specifically, as the opening/closing cover 231 is moved, the canceling piece 234 is rotated about the canceling piece shaft portion 234Z (arrow D181 of FIG. 18, arrow D191 of FIG. 19). As a result, the first inclined portion 234C of the canceling piece 234 pushes the uncoupling member contact portion 75A downward while coming into contact with a rear end portion 75A1 of the uncoupling member contact portion 75A. In this way, the uncoupling member 75 is rotated as shown by an arrow D182 of FIG. 18 and an arrow D192 of FIG. 19 about the uncoupling member shaft portion 75Z. The rotation of the uncoupling member 75 brings the 11th contact portion 75C1 into contact with the flange portion 701B of the drive coupling portion 701 (the same also holds for the unillustrated 21st contact portion) as shown in FIG. 19. As a result, the drive coupling portion 701 starts moving backward while the compression spring 703 is compressed.

Further, when the opening/closing cover 231 is completely opened, the canceling piece 234 and the uncoupling member 75 are set in states as shown in FIGS. 13, 14 and 21 to 23. Specifically, after the canceling piece 234 is further rotated about the canceling piece shaft portion 234Z as the opening/closing cover 231 is moved (arrow D131 of FIG. 13), the canceling piece projecting portion 234T of the canceling piece 234 is arranged to project vertically downward. As a result, the second inclined portion 234D of the canceling piece 234 comes into contact (engagement) with the uncoupling member contact portion 75A and the uncoupling member contact portion 75A is maximally pushed downward (arrow D132 of FIG. 13). This causes the 12th contact portion 75C2 of the first projecting piece 75C to move to a second position to come into contact with the flange portion 701B of the drive coupling portion 701 as shown in FIG. 22 (the same also holds for the unillustrated 22nd contact portion of the second projecting piece 75D). As a result, the compression spring 703 is most compressed and the drive coupling portion 701 is located at a rearmost position (position A2 of FIG. 10, arrow D141 of FIG. 14). Then, as shown in FIG. 22, the shaft 31A is separated from the drive coupling portion 701 and the driving unit 700 (the drive shaft 702) and the shaft 31A are uncoupled. In other words, the transmission of the rotational drive force between the driving unit 700 and the feed roller 31 is cut off. In this way, the drive transmission switching unit 7 separates the shaft projection 31B from the cut portion 701C by relatively moving the drive coupling portion 701 in the axial direction with respect to the drive shaft 702 while compressing the compression spring 703.

In changing the state of the opening/closing cover 231 from the open state to the close state, the above operation is performed in a reverse order. Specifically, when the opening/closing cover 231 starts being closed, the canceling piece 234 is rotated to change the state of FIG. 21 to that of FIG. 18. At this time, by a restoring force of the compression spring 703, the drive coupling portion 701 is moved forward while biasing the first projecting piece 75C (second projecting piece 75D). By a biasing force of the drive coupling portion 701, the uncoupling member 75 is rotated to change the state of FIG. 21 to that of FIG. 18. As a result, the contact position of the canceling piece 234 with the uncoupling member contact portion 75A is moved from the second inclined portion 234D to the first inclined portion 234C. When the opening/closing cover 231 is eventually completely closed, the canceling piece 234 and the uncoupling member 75 return to the states of FIGS. 15 to 17. As a result, the shaft 31A is inserted into the drive coupling portion 701 and the shaft projection 31B is engaged with the cut portion 701C again. Specifically, the driving unit 700 and the shaft 31A are coupled.

As just described, according to this embodiment, the first projecting piece 75C (second projecting piece 75D) is rotatable about the uncoupling member shaft portion 75Z extending in the direction intersecting with the shaft 31A and the position thereof can be changed between the first position and the second position according to the open and closed states of the opening/closing cover. In the closed state of the opening/closing cover 231, the first projecting piece 75C (second projecting piece 75D) is arranged at the first position by being separated from the drive coupling portion 701 and causes the cut portion 701C and the shaft projection 31B to be engaged. Further, in the open state of the opening/closing cover 231, the first projecting piece 75C (second projecting piece 75D) is arranged at the second position to be engaged with the drive coupling portion 701 and separates the shaft projection 31B from the cut portion 701C by moving the drive coupling portion 701 in the axial direction.

As the position of the first projecting piece 75C is changed from the first position to the second position, the drive coupling portion 701 is moved in the axial direction and the shaft projection 31B is separated from the cut portion 701C. Thus, the feed roller 31 and the driving unit 700 can be uncoupled by a state change of the first projecting piece 75C. Further, the canceling piece 234 is rotatable about a shaft of the opening/closing cover 231. Further, in the open state of the opening/closing cover 231, the canceling piece 234 projects toward the internal space 25, is engaged with the uncoupling member contact portion 75A of the uncoupling member 75 and moves the first projecting piece 75C (second projecting piece 75D) to the second position. Thus, the feed roller 31 and the driving unit 700 can be uncoupled according to the rotation of the canceling piece 234 associated with opening and closing movements of the opening/closing cover 231.

Further, according to the image forming apparatus including the side deck 1 according to this embodiment, even if an image forming operation of the image forming apparatus is interrupted due to the removing and mounting operations of the sheet feeding unit 3, the removing and mounting operations are performed in a short time and an interruption time can be made as short as possible.

Although the side deck 1 (sheet conveying apparatus) including the sheet feeding unit 3 according to this embodiment and the image forming apparatus provided with this are described above, the present disclosure is not limited to these embodiments and can be, for example, modified as follows.

(1) Although the canceling piece 234 and the uncoupling member 75 are provided as the drive transmission switching unit 7 in the above embodiment, the present disclosure is not limited to this. Another canceling piece arranged coaxially with a rotary shaft of the opening/closing cover 231 instead of the canceling piece 234 may directly move the drive coupling portion 701. In this case, the other canceling piece extends in a direction (forward) opposite to the extending direction of the canceling piece 234 in FIG. 15. A torsion spring or the like is arranged on the other canceling piece and the other canceling piece is rotated in a direction opposite to the rotating direction of the opening/closing cover 231 as the opening/closing cover 231 is opened and closed. Specifically, in FIG. 15, the canceling piece is rotated counterclockwise as the state of the opening/closing cover 231 is changed from the closed state to the open state. Then, a leading end portion of the canceling piece directly moves the flange portion 701B of the drive coupling portion 701 backward.

(2) Although the canceling piece 234 is rotated about the canceling piece shaft portion 234Z of the opening/closing cover 231 in the above embodiment, the present disclosure is not limited to this. The canceling piece 234 may be rotated about a specific rotary shaft.

(3) Although the drive coupling portion 701 to be moved according to opening and closing movements of the opening/closing cover 231 is arranged on the drive shaft 702 in the above embodiment, the present disclosure is not limited to this. The drive coupling portion 701 may be arranged on the shaft 31A of the sheet feeding unit 3.

(4) Although the feed roller 31 is used as a sheet feeding member, to which a rotational drive force is transmitted, in the above embodiment, the present disclosure is not limited to this. The sheet feeding member may be another member such as a sheet feeding belt, to which a rotational drive force is transmitted to convey a sheet.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet conveying apparatus, comprising:

a casing with an internal space;

a sheet placing portion which is arranged in the internal space and on which a sheet is to be placed;

a sheet feeding unit which is arranged in the internal space to face the sheet and includes a sheet feeding member having a rotational drive system for conveying the sheet in a predetermined direction by being driven and rotated, the rotational drive system having a first rotary shaft extending in a direction intersecting with mounting and removing directions of the sheet feeding unit;

a driving unit which is arranged in the internal space and coupled to the rotational drive system of the sheet feeding member and transmits a rotational drive force to the sheet feeding member, the driving unit including a drive shaft extending coaxially with the first rotary shaft while facing the first rotary shaft when the sheet feeding unit is mounted to the internal space;

an opening which is formed in the casing and exposes the sheet feeding unit to the outside of the casing;

a cover which is openably and closably arranged on the casing to cover the opening and exposes the sheet feeding unit in an open state; and a drive switching unit which uncouples the driving unit and the sheet feeding member in association with a switching movement of the cover from a closed state to the open state, the drive switching unit uncouples the driving unit and the rotational drive system of the sheet feeding member by uncoupling the first rotary shaft and the drive shaft in an axial direction of the first rotary shaft;

wherein the sheet feeding unit is mountable into and removable from the internal space through the opening in the open state of the cover.

2. A sheet conveying apparatus according to claim 1, wherein:

the sheet feeding unit includes a holding portion arranged to face the opening and is mountable into and removable from the internal space through the opening.

3. A sheet conveying apparatus according to claim 1, wherein:

the opening is formed in an upper surface portion of the casing; and the sheet feeding unit is mountable and removable in a vertical direction through the opening.

4. A sheet conveying apparatus according to claim 1 wherein:

the first rotary shaft includes a first projection projecting in a radial direction of the first rotary shaft from an end part of the outer circumferential surface of the first rotary shaft on the side of the driving unit;

the drive shaft includes a second projection which projects in a radial direction of the drive shaft from the outer circumferential surface of the drive shaft;

the driving unit includes a cylindrical portion which is fitted onto the drive shaft slidably and into which the first rotary shaft is inserted when the sheet feeding unit is mounted to the internal space; the cylindrical portion includes a cut portion which is formed by cutting the circumferential surface of the cylindrical portion in the axial direction from an end edge facing the first rotary shaft and with which the second projection is to be engaged;

when the sheet feeding unit is mounted to the internal space and the first rotary shaft is inserted into the cylindrical portion, a rotational drive force is transmitted from the drive shaft to the first rotary shaft and the first rotary shaft is integrally rotated with the drive shaft by the engagement of the first projection with the cut portion; and the drive switching unit uncouples the drive shaft from the first rotary shaft by moving the cylindrical portion in the axial direction to separate the first projection from the cut portion.

5. A sheet conveying apparatus according to claim 4, further comprising:

a wall portion which is arranged to face a end surface of the cylindrical portion opposite to the first rotary shaft on the drive shaft; and a spring member through which the drive shaft is inserted and which is compressively arranged between the end surface of the cylindrical portion and the wall portion and which biases the cylindrical portion toward the first rotary shaft;

wherein the drive switching unit separates the first projection from the cut portion by relatively moving the cylindrical portion in the axial direction with respect to the drive shaft while compressing the spring member.

6. A sheet conveying apparatus according to claim 4, wherein the drive switching unit includes:

a second rotary shaft which extends in a direction intersecting with the first rotary shaft in the casing; and a first contact member which is rotatable about the second rotary shaft and displaceable between a first position where the first contact member is separated from the cylindrical portion in the closed state of the cover to engage the cut portion and the first projection and a second position where the first contact member separates the first projection from the cut portion by coming into contact with the cylindrical portion and moving the cylindrical portion in the axial direction according to the switching movement of the cover from the closed state to the open state.

7. A sheet conveying apparatus according to claim 6, wherein:

the cover is rotatably supported on a third rotary shaft extending in a direction intersecting with the first rotary shaft in the casing and can be changed the state thereof between the open state and the closed state by the rotation of one end of the cover about the third rotary shaft;

the cylindrical portion includes a flange portion connected consecutively to the end surface and projecting in a radial direction of the cylindrical portion; and the drive switching unit includes:

a rotating member which extends along the drive shaft and the rotating member includes; a base plate portion rotatable about the second rotary shaft, a first contact member connected to the base plate portion and arranged to be able to come into contact with the flange portion and a contacted portion arranged on the base plate portion; and a second contact member which is rotatable about the third rotary shaft, extends along the cover in the closed state of the cover, and projects toward the internal space and is engaged with the contacted portion of the rotating member to move the first contact member to the second position in the open state of the cover.

8. A sheet conveying apparatus according to claim 1 wherein:

the sheet feeding unit includes:

a cover member which covers the sheet feeding member; and a bearing portion which is provided on the cover member and through which the first rotary shaft of the sheet feeding member is to be inserted;

wherein the sheet feeding unit further comprises a bearing mounting portion arranged to be mounted the bearing portion thereon is further provided in the internal space of the casing; and the sheet feeding unit is mounted into the internal space by fitting the bearing portion into the bearing mounting portion.

9. An image forming apparatus, comprising:

a sheet conveying apparatus for conveying a sheet; and an image forming unit for forming an image on the sheet;

wherein the sheet conveying apparatus includes:

a casing with an internal space;

a sheet placing portion which is arranged in the internal space and on which a sheet is to be placed;

a sheet feeding unit which is arranged in the internal space to face the sheet and includes a sheet feeding member having a rotational drive system for conveying the sheet in a predetermined direction by being driven and rotated, the rotational drive system having a first rotary shaft extending in a direction intersecting with mounting and removing directions of the sheet feeding unit;

a driving unit which is arranged in the internal space and coupled to the rotational drive system of the sheet feeding member and transmits a rotational drive force to the sheet feeding member, the driving unit including a drive shaft extending coaxially with the first rotary shaft while facing the first rotary shaft when the sheet feeding unit is mounted to the internal space;

an opening which is formed in the casing and exposes the sheet feeding unit to the outside of the casing;

a cover which is openably and closably arranged on the casing to cover the opening and exposes the sheet feeding unit in an open state; and a drive switching unit which uncouples the driving unit and the sheet feeding member in association with a switching movement of the cover from a closed state to the open state, the drive switching unit uncouples the driving unit and the rotational drive system of the sheet feeding member by uncoupling the first rotary shaft and the drive shaft in an axial direction of the first rotary shaft;

wherein the sheet feeding unit is mountable into and removable from the internal space through the opening in the open state of the cover.

10. An image forming apparatus according to claim 9, wherein:

the sheet feeding unit includes a holding portion arranged to face the opening and is mountable into and removable from the internal space through the opening.

11. An image forming apparatus according to claim 9, wherein:

the opening is formed in an upper surface portion of the casing; and the sheet feeding unit is mountable and removable in a vertical direction through the opening.

12. An image forming apparatus according to claim 9, wherein:

the first rotary shaft includes a first projection projecting in a radial direction of the first rotary shaft from an end part of the outer circumferential surface of the first rotary shaft on the side of the driving unit;

the drive shaft includes a second projection which projects in a radial direction of the drive shaft from the outer circumferential surface of the drive shaft;

the driving unit includes a cylindrical portion which is fitted onto the drive shaft slidably and into which the first rotary shaft is inserted when the sheet feeding unit is mounted to the internal space; the cylindrical portion includes a cut portion which is formed by cutting the circumferential surface of the cylindrical portion in the axial direction from an end edge facing the first rotary shaft and with which the second projection is to be engaged;

when the sheet feeding unit is mounted to the internal space and the first rotary shaft is inserted into the cylindrical portion, a rotational drive force is transmitted from the drive shaft to the first rotary shaft and the first rotary shaft is integrally rotated with the drive shaft by the engagement of the first projection with the cut portion; and the drive switching unit uncouples the drive shaft from the first rotary shaft by moving the cylindrical portion in the axial direction to separate the first projection from the cut portion.

13. An image forming apparatus according to claim 12, further comprising:

a wall portion which is arranged to face a end surface of the cylindrical portion opposite to the first rotary shaft on the drive shaft; and a spring member through which the drive shaft is inserted and which is compressively arranged between the end surface of the cylindrical portion and the wall portion and which biases the cylindrical portion toward the first rotary shaft;

wherein the drive switching unit separates the first projection from the cut portion by relatively moving the cylindrical portion in the axial direction with respect to the drive shaft while compressing the spring member.

14. An image forming apparatus according to claim 12, wherein the drive switching unit includes:

a second rotary shaft which extends in a direction intersecting with the first rotary shaft in the casing; and a first contact member which is rotatable about the second rotary shaft and displaceable between a first position where the first contact member is separated from the cylindrical portion in the closed state of the cover to engage the cut portion and the first projection and a second position where the first contact member separates the first projection from the cut portion by coming into contact with the cylindrical portion and moving the cylindrical portion in the axial direction according to the switching movement of the cover from the closed state to the open state.

15. An image forming apparatus according to claim 14, wherein:

the cover is rotatably supported on a third rotary shaft extending in a direction intersecting with the first rotary shaft in the casing and can be changed the state thereof between the open state and the closed state by the rotation of one end of the cover about the third rotary shaft;

the cylindrical portion includes a flange portion connected consecutively to the end surface and projecting in a radial direction of the cylindrical portion; and the drive switching unit includes:

a rotating member which extends along the drive shaft and the rotating member includes; a base plate portion rotatable about the second rotary shaft, a first contact member connected to the base plate portion and arranged to be able to come into contact with the flange portion and a contacted portion arranged on the base plate portion; and a second contact member which is rotatable about the third rotary shaft, extends along the cover in the closed state of the cover, and projects toward the internal space and is engaged with the contacted portion of the rotating member to move the first contact member to the second position in the open state of the cover.

16. An image forming apparatus according to claim 9, wherein:

the sheet feeding unit includes:

a cover member which covers the sheet feeding member; and a bearing portion which is provided on the cover member and through which the first rotary shaft of the sheet feeding member is to be inserted;

wherein the sheet feeding unit further comprises a bearing mounting portion arranged to be mounted the bearing portion thereon is further provided in the internal space of the casing; and the sheet feeding unit is mounted into the internal space by fitting the bearing portion into the bearing mounting portion.

* * * * *